US010712130B2

(12) United States Patent
Leimbach

(10) Patent No.: US 10,712,130 B2
(45) Date of Patent: Jul. 14, 2020

(54) PORTABLE NET AND DEPLOYMENT SYSTEM

(71) Applicant: Wendell Leimbach, Saint Leonard, MD (US)

(72) Inventor: Wendell Leimbach, Saint Leonard, MD (US)

( * ) Notice: Subject to any disclaimer, the term of this patent is extended or adjusted under 35 U.S.C. 154(b) by 636 days.

(21) Appl. No.: 15/347,047

(22) Filed: Nov. 9, 2016

(65) Prior Publication Data

US 2018/0128579 A1 May 10, 2018

(51) Int. Cl.
*F41H 13/00* (2006.01)

(52) U.S. Cl.
CPC ..... *F41H 13/0006* (2013.01)

(58) Field of Classification Search
CPC ..... A01K 69/00; A01K 69/02; A01K 71/00; A01K 73/00; A01K 73/02; A01K 73/12; A01K 74/00; A01K 75/00; A01K 75/06; A01K 77/00; F41H 13/0006; F41H 13/00; A61F 5/00
See application file for complete search history.

(56) References Cited

U.S. PATENT DOCUMENTS 1,341,552 A * 5/1920 Goss ..... A01K 73/12 43/7
1,786,342 A * 12/1930 Greene ..... A01K 73/12 43/8
2,549,475 A * 4/1951 Jardim ..... A01K 73/12 43/11
2,565,955 A * 8/1951 Dobreff ..... A01K 73/12 43/7
2,810,979 A * 10/1957 Puretic ..... A01K 73/06 43/8
3,044,206 A * 7/1962 Luketa ..... A01K 73/02 43/9.3
3,213,560 A * 10/1965 Phillips ..... A01K 73/12 43/7
3,412,498 A * 11/1968 Niskin ..... A01K 80/00 43/8
4,381,617 A * 5/1983 McSweeny, Jr. ..... A01K 75/00 43/14
4,763,432 A * 8/1988 Barclay ..... A01K 75/00 43/10
4,986,021 A * 1/1991 Thomas ..... A01K 73/12 294/77

(Continued)

FOREIGN PATENT DOCUMENTS

AU 719899 B2 * 5/2000 ..... F41H 13/0006
DE 3735426 A1 * 5/1989 ..... F41H 13/0006

(Continued)

*Primary Examiner* — Kathleen I Alker
(74) *Attorney, Agent, or Firm* — John T. Whelan

(57) ABSTRACT

A containment system for use by a user and an assistant to be thrown by the user onto a fugitive disposed between the user and the assistant. The containment system includes: a net having a perimeter and a center; a first weight disposed at the perimeter; a second weight disposed at the perimeter; a primary weight connected to the net a user one-way cord lock; and a user cord disposed through the user one-way cord lock and associated with the perimeter. The user one-way cord lock enables one-way movement of the user cord therethrough when pulled upon so as to constrict the net at the perimeter.

6 Claims, 39 Drawing Sheets

(56) References Cited

U.S. PATENT DOCUMENTS 5,161,322 A * 11/1992 Bulling ..... A01K 75/00 256/23
5,209,005 A * 5/1993 Krager ..... A01K 71/00 24/908
5,291,682 A * 3/1994 Zaccheo ..... A01K 79/02 367/139
6,219,959 B1 * 4/2001 Hsieh ..... E05G 5/02 109/3
6,375,532 B1 * 4/2002 Eiband ..... B63C 9/08 441/84
6,904,838 B1 * 6/2005 Dindl ..... B64D 45/0015 89/1.1
8,161,676 B1 * 4/2012 Beach ..... A01K 74/00 43/7
2002/0139032 A1 * 10/2002 Campbell ..... A01K 74/00 43/11
2003/0056421 A1 * 3/2003 Ardern ..... A01K 74/00 43/8
2003/0131519 A1 * 7/2003 Fickling, Jr. ..... A01K 73/12 43/14
2004/0200119 A1 * 10/2004 Ardern ..... A01K 74/00 43/8
2005/0039372 A1 * 2/2005 Amore ..... A01K 74/00 43/8
2005/0240132 A1 * 10/2005 Jones ..... A61F 5/37 602/19
2015/0316345 A1 * 11/2015 Brahler, II ..... F41B 11/72 124/73
2016/0205905 A1 * 7/2016 Souther ..... A01K 74/00

FOREIGN PATENT DOCUMENTS

DE 29701149 U1 * 5/1997 ..... F41H 13/0006
DE 19716527 C1 * 10/1998 ..... F41H 13/0006
FR 2659830 A1 * 9/1991 ..... A01K 73/12
KR 2016108624 * 9/2016 ..... A01K 74/00

* cited by examiner

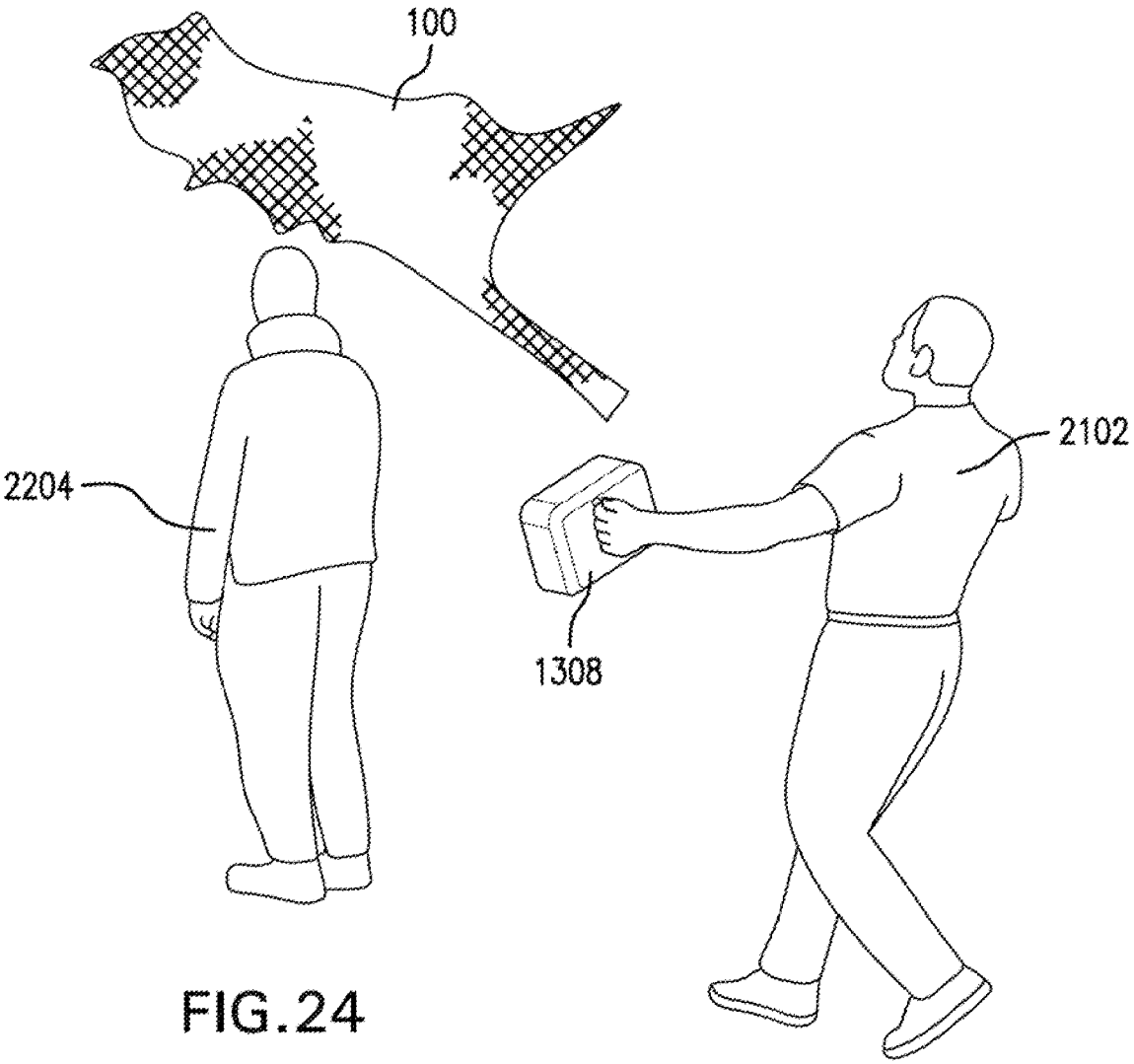
FIG.24
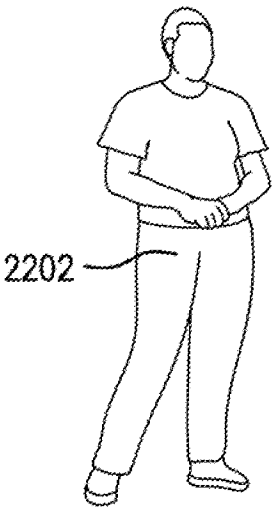

PORTABLE NET AND DEPLOYMENT SYSTEM

The present application claims priority from: U.S. Provisional Application No. 62/253,187 filed Nov. 10, 2015, the entire disclosure of which is incorporated herein by reference.

BACKGROUND

Embodiments of the invention relate to less lethal restraining systems.

Currently, law enforcement officers have limited tools available to restrain and secure fugitives that are physically out of control. Typically, an officer has a handgun, Taser, baton and/or their personal strength/fists to use to bring a combative fugitive under control so that the fugitive can be handcuffed. These tools require the officer to overwhelm the fugitive with force and all too often bring injury to those involved. All of the tools are aggressive and can lead to claims of police brutality.

There exists a need for a system and method for restraining and capturing a fugitive, while minimizing injury to the fugitive and officers.

SUMMARY

Aspects of the present invention are drawn to a containment system for use by a user and an assistant to be thrown by the user onto a fugitive disposed between the user and the assistant. The containment system includes: a net having a perimeter and a center; a first weight disposed at the perimeter; a second weight disposed at the perimeter; a primary weight connected to the net: a user one-way cord lock; and a user cord disposed through the user one-way cord lock and associated with the perimeter. The user one-way cord lock enables one-way movement of the user cord therethrough when pulled upon so as to constrict the net at the perimeter.

BRIEF SUMMARY OF THE DRAWINGS

The accompanying, drawings, which are incorporated in and form a part of the specification, illustrate example embodiments and, together with the description, serve to explain the principles of the invention. In the drawings:

FIG. 24 illustrates launching of the containment system of FIG. 1 from the deployment system of FIG. 13 at a time $t_3$;

DETAILED DESCRIPTION

Figure 1:
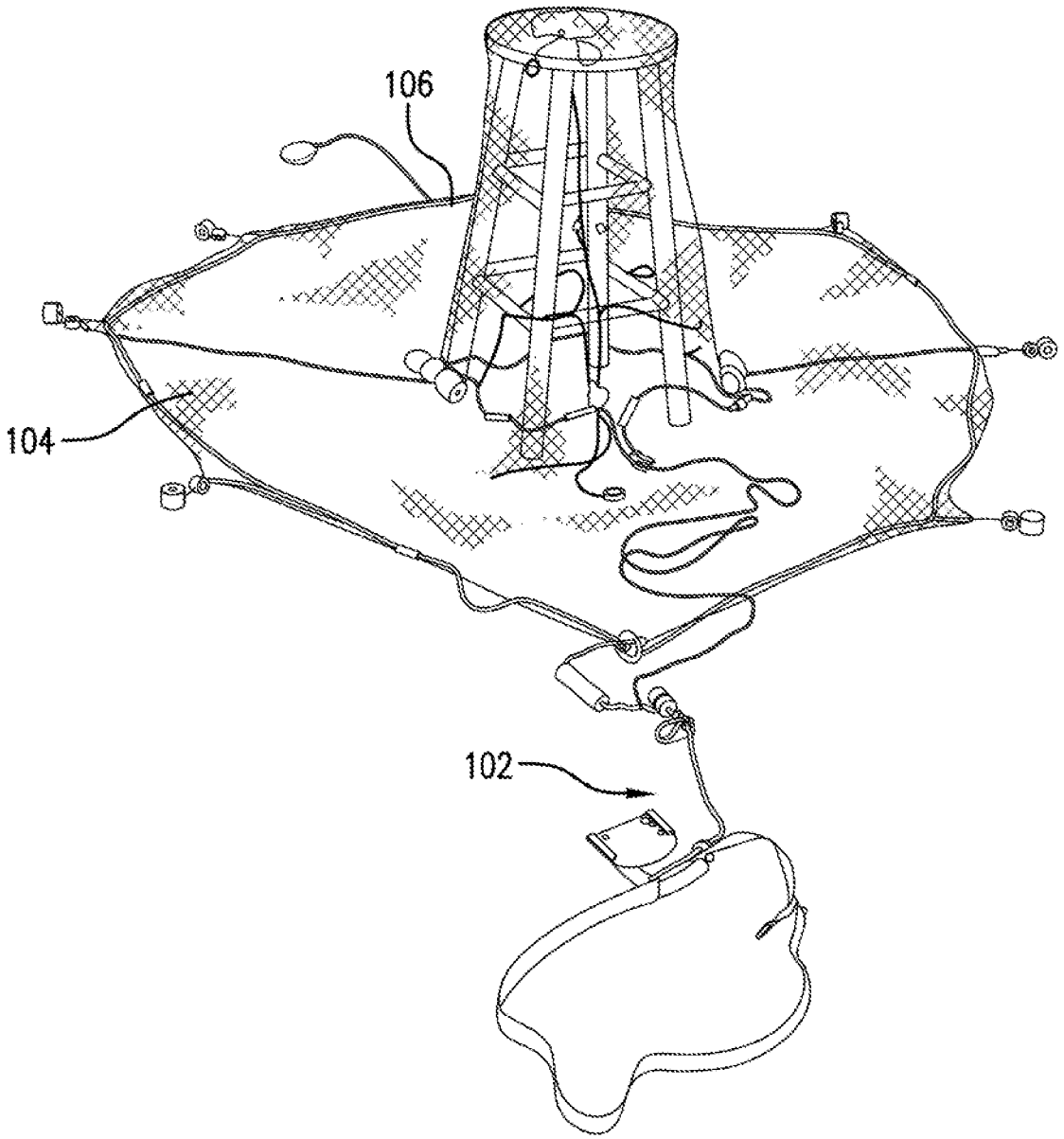
FIG. 1 illustrates an example containment system in accordance with aspects of the present invention.

Aspects of the present invention are drawn to a portable net that is deployed over and around a fugitive and then tightened around the circumference to safely restrain and secure the fugitive so that they cannot escape or physically attack others.

This invention is a portable net that is deployed over and around a fugitive and then tightened around the circumference to safely restrain and secure the fugitive so that they cannot escape or physically attack others. The net is carried and deployed over the fugitive by one officer and secured around the fugitive with or without the assistance of a second officer. Because the portable net, is a nonviolent tool, it can be safely used to restrain males or females of all ages.

The term "officer" is used here to refer to people with the responsibility and authority to restrain and secure individuals. The term fugitive is used here to refer to an individual who (1) has broken the law or (2) is disorderly and must be brought under control or (3) is a suspect that must be restrained without being force to the ground (i.e., person carrying a suspicious package).

The net is thrown over part or the entire fugitive to be secured and then tightened by one or more cords to gather and lock the net circumference around the fugitive. The fugitive can be restrained and secured while in many positions (a single individual standing, crouching, sitting on the ground, on their hands and knees, lying on the backs with their legs in the air, or a pair of fighting individuals in those positions). The net needs to surround the body and/or legs, before it is tightened. In cases where the fugitive is very combative, it may be necessary to deploy the net after a Taser or other less lethal tools are used. Other example uses include deploying onto a fugitive when the fugitive is laying on their back with their legs in the air. The net may be thrown over the legs and tightened around the waist. The hobbles will close in around the knees. If the fugitive stands up and tries to remove the net, a second net can be thrown over them.

To deploy the net over and around the fugitive, the net is thrown from a container by one officer who is standing behind the fugitive. The net is thrown above the fugitive and towards the second officer that on the opposite side, in front of the fugitive. The container prevents the net from tangling while in storage and directs the force of the throw so that the net opens to its full circumference in a short distance. Around the circumference are weighs that provide both forward and lateral momentum during the throw and help to bring the net quickly towards the ground around the fugitive. There are two adjacent cords running around the circumference of the net. A cord, as used herein, may be any long, thin, flexible string or rope.

To start the process, the officer with the container places a breakaway shoulder strap over one shoulder and attaches the container to a quick-release clip at waist level. In this configuration the officer is able to be "hands free" before the net is deployed. When it is clear that the net will be deployed the officer positions himself behind the fugitive and grabs the container, releasing it from the clip. The officer holds the container with both hands such that the two attached laser pointers are pointing at the fugitive. The lasers are turned on so that the laser beams create two dots on the back of the fugitive. The officers move towards or away from the fugitive until the two dots converge. At that position the officer is the proper distance from the fugitive so that the center of the net will land on the fugitive's head.

The shoulder strap is attached to the start of the first cord is attached to a cord stop running through a cord ring, then through the first one-way slip lock, around the circumference of the net back through the first one-way slip lock, through the first handle and terminates at the cord ring around the cord stop. The second cord starts with a weighted cord extension that terminates in a second handle. The weighted cord extension will be next to the second officer on the opposite side after the net is deployed. The second cord starts in the second handle, runs through a second one-way slip lock, around the circumference of the net, back through the second slip lock and terminates in the second handle.

To gather and lock the net, the two handles are polled from opposite or substantially opposite sides of the net for several feet in opposite or substantially opposite directions away from the fugitive. By pulling the cords, the fugitive is trapped by the net and the cords in between the two officers. The locking mechanism on each cord slips as the cord is tightened but locks in the opposite direction to prevent the net from loosening.

In alternative embodiments, not shown, there may be only one officer and a first cord, or there may be two or more officers and two or more cords.

In addition to the cords that gather at the feet of the individual, the system also has two hobble cords that gather around the waist and arms. The cord around the waist keeps the individual from reaching into their pockets which could conceal a weapon. The hobble cord around the arms is used, when necessary, to restrict the movement of the fugitive's arms. The net is a nonviolent system since the officers do not have to be in physical contact with the fugitive to deploy the net or gather the circumference to secure the fugitive.

In the case where the fugitive is standing and starts to run as the net is deployed, the net circumference may not reach down to the legs. The second officer may not have time to grab the second handle as the fugitive starts to run. In that case, the cord that is attached to the first officer's shoulder strap will start to tighten like a lasso. As the fugitive is running, the circumference might move up the body and around the neck as it is tightening.

To prevent choking, the cords run through spacer tubes around the circumference of the net. When the net is fully tightened the spacer tubes maintain a sufficient opening to prevent choking. In the unlikely event that the fugitive, with the net deployed over them, can climb into a vehicle, the shoulder strap has a breakaway feature so that the officer cannot be trapped and dragged by the cords.

There are two release threads that allow the net to be quickly opened. The first is at waist level so the police can grab the individual's hands for handcuffing. After the individual is under control, the full net is quickly released from the fugitive by removing the second release thread and pulling the net over the individual's head. The full net can then drop to the ground.

In another deployment configuration, the net can be used to capture and secure individuals in confined spaces such as schools and court rooms. The net will be cylindrically shaped with the top end closed. In this configuration the sides of the net will be stored in a ring shaped container which is approximately three feet in diameter. At the base of the net will be cords that are deployed in the same manner as described above.

The net and deployment system can also be used to restrain and secure animals, birds and fish. In these cases only a single cord attached to the thrower may be required.

Aspects of the present invention will now be described in greater detail with reference to FIGS. 1-39. In particular, an example containment system will be described with reference to FIGS. 1-12, an example deployment system will be described with reference to FIGS. 13-16, an example method of loading the containment system within the deployment system will be described with reference to FIGS. 17-20 and a method of deploying the containment system from the deployment system will be described with reference to FIGS. 21-29.

A containment system 100 in accordance with aspects of the present invention will now be described with reference to FIG. 1-12.

FIG. 1 illustrates containment system 100 in accordance with aspects of the present invention.

As shown in the figure, containment system 100 includes a user end 102, a central portion 104 and an assistant end 106. User end 102 will first be described in greater detail with additional reference to FIGS. 2-3, wherein central portion 104 will then be described in greater detail with reference to FIGS. 4-11 and assistant end 106 will finally be described in greater detail with reference to FIG. 12.

Figure 2:
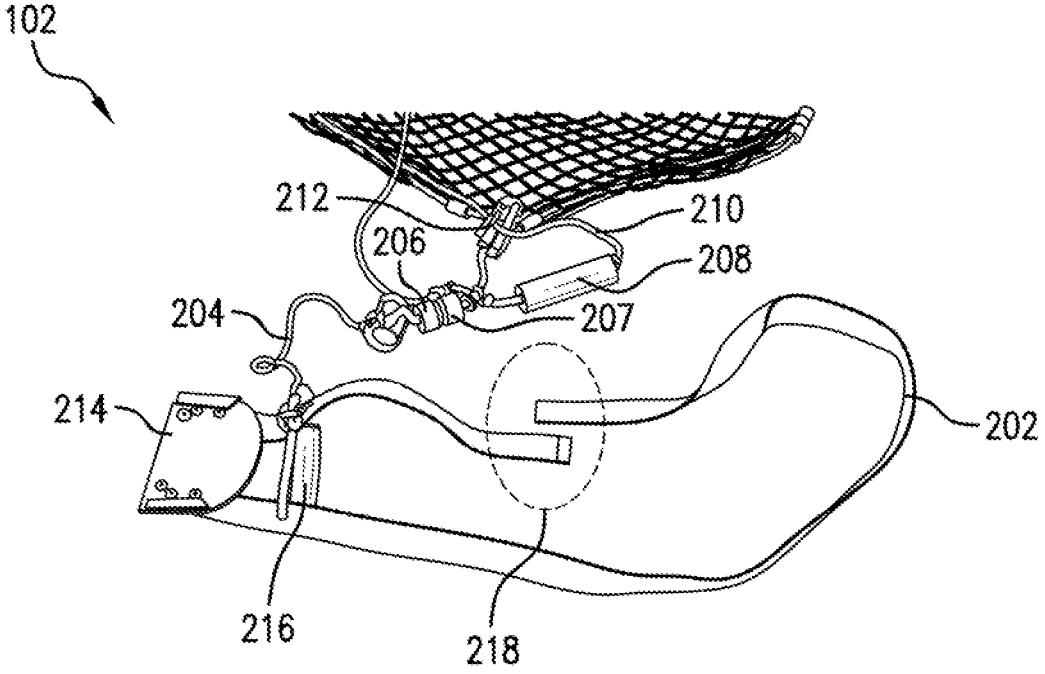
FIG. 2 illustrates an exploded view of a user end of the example containment system of FIG. 1.

FIG. 2 illustrates an exploded view of user end 102.

As shown in the figure, user end 102 includes a breakaway shoulder strap 202, a user cord extension 204, a user cord stop 206, a cord ring 207, a user handle 208, a user cord 210 and a user one-way cord lock 212. Breakaway shoulder strap 202 includes a quick-release clip 214, a lasso handle 216 and a releasable fastening component 218.

Breakaway shoulder strap 202 is attached to cord extension 204. In an example embodiment, each of cord extension 204 and user cord 210 is high strength parachute cord (i.e., paracord).

Breakaway shoulder strap 202 enables user end 102 to be worn by a user. Quick-release clip 218 attaches to a deployment system, as will be discussed in greater detail below, to maintain an anchored connection when initially deploying containment system 100 and to easily disconnect from the deployment system shortly thereafter. Breakaway shoulder strap 202 is one non-limiting example embodiment of a breakaway feature. In other embodiments, a shoulder strap may be carried around the officer's waist or a quick-release clip and cord with a breakaway feature may be attached directly to the officer's duty belt.

User cord extension 204 provides an extension from breakaway shoulder strap 202 to user handle 208. User cord extension 204 may be adjusted, for example by +/– two feet, to accommodate the characteristics of the fugitive, the user, and/or the deployment location.

User cord stop 206 may be any device or system that prevents user cord extension 204 from passing through cord ring 207 when user handle 208 is being pulled away from the fugitive, yet allows cord ring 207 to release from user cord stop 206, acting like a lasso loop, in the event the fugitive runs away from the officers before they can grab user handle 208 and an assistant handle as will be described later. In the case where the fugitive is running from the officers, lasso handle 216 is grabbed.

User handle 208 enables a user to quickly find and grasp user cord 210. It should be noted that user handle 208 is not required. However, user handle 208 reduces the strain on the user's hands.

User cord 210 extends from user handle 208, around central portion 104 and back to user handle 208. When pulled by user handle 208, user cord 210 constricts central portion 104, as will be discussed in greater detail below.

Releasable fastening component 218 may be any device or system enables breakaway shoulder strap 202 to disengage from a user. For example, in an unlikely event that containment system 100 is snagged on a moving vehicle, or a fugitive wearing containment system 100 enters a vehicle to drive away, a user will not be dragged along with containment system 100. In an example embodiment, releasable fastening component 218 includes a hook and loop system, e.g., Velcro or the like, attached to mating portions of breakaway shoulder strap 202.

One-way cord lock 212 may be any device or system that permits one-way movement of user cord 210 and that includes an unlocking mechanism to enable two-way movement.

Figure 3:
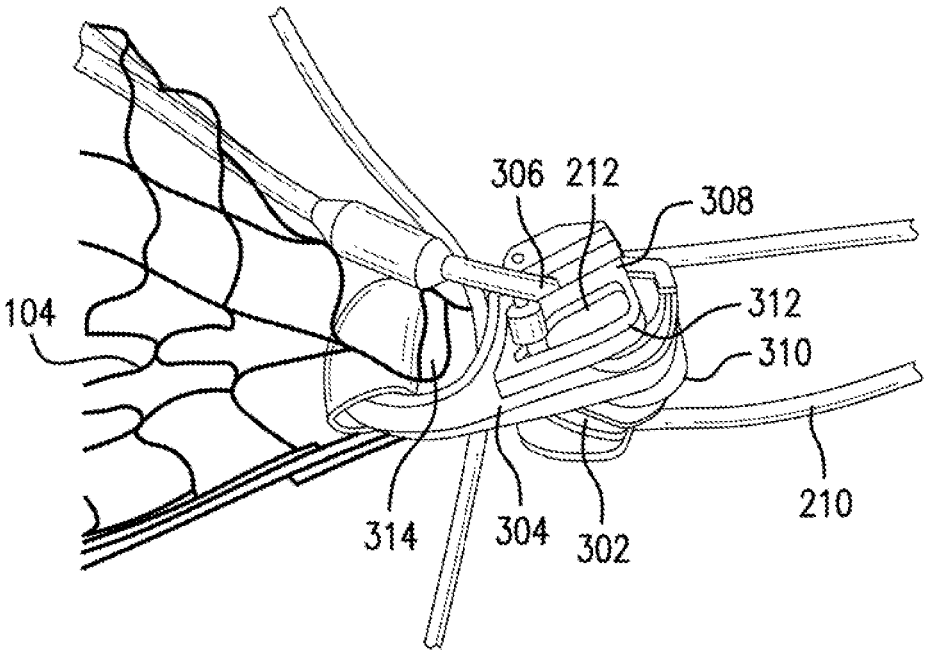
FIG. 3 illustrates an exploded view of a user one-way cord lock of the example containment system of FIG. 1.

FIG. 3 illustrates an exploded view of user one-way cord lock 212.

As shown in the figure, user one-way cord lock 212 includes a cord entrance 302, a cord exit 304, a cord entrance 306, a cord exit 308, a lock/release mechanism 310, a lock/release mechanism 312 and a non-locking opening 314.

User cord 210 runs from cord stop 206 (not shown), into cord entrance 302, past lock release mechanism 310, out cord exit 304, around central portion 104, returns into cord entrance 306, past lock/release mechanism 312, out cord exit 308 and returns to user handle 208 before terminating in cord ring 207.

By pulling user handle 208, the amount of user cord 210 between cord entrance 302 and user handle 208 and the amount of user cord 210 between cord exit 308 and user handle increases, while the amount of user cord 210 between cord exit 304 and cord entrance 306, i.e., the amount of user cord 210 around central portion 104, decreases. As such, user cord 210 constricts central portion 104 when user handle 208 is pulled.

Lock/release mechanism 310 and lock/release mechanism 312 permit a one-way movement of user cord 210. In this manner, once constricted around central portions 104, central portion 104 cannot be widened without unlocking at least one of lock/release mechanism 310 and lock/release mechanism 312.

Central portion 104 will now be described in greater detail with reference to FIGS. 4-11.

Figure 4:
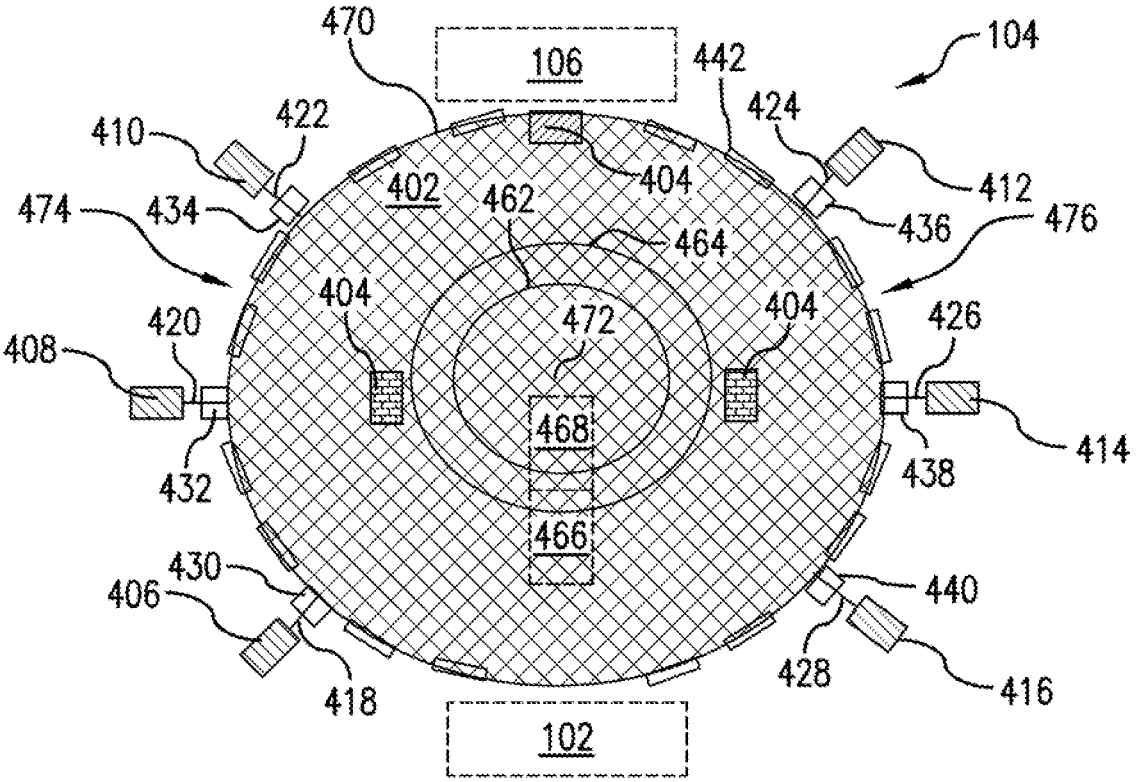
FIG. 4 illustrates an exploded view of a central portion of the example containment system of FIG. 1.

FIG. 4 illustrates an exploded view of central portion 104.

As shown in the figure, central portion 104 includes: a conical net 402; a primary weight 404; lateral weights 406, 408, 410, 412, 414 and 416; monofilament lines 418, 420, 422, 424, 426 and 428; weighted springs 430, 432, 434, 436, 438, and 440; a plurality of spacer tubes, an example of which is labeled as spacer tube 442; soft weights 458 and 460; a mid-level hobble 462; an upper-level hobble 464; a mid-level net release 466; and an upper-level net release 468.

Conical net 402 has a circumference 470, a center 472, a side portion 474 and side portion 476. In an example embodiment, conical net 402 is a truncated cone using a double angle conical shape with a short taper from the top to shoulder area and a long taper from the shoulder to the ground.

It should be noted that any shaped net may be used. A conical net, having a circular cross section when deployed over a fugitive, is described throughout for purposes of discussion only. In the event another shaped net is used, a perimeter of such a net would correspond to the circumference of a conical net.

In this non-limiting example embodiment, conical net 402 is made of strong, flexible net material (i.e., sports netting). In an example embodiment, conical net 402 has a base diameter of approximately six feet and an apex of approximately seven feet. Conical net 402 is thrown over a fugitive so that net center 472, when deployed, will be positioned approximately on top of the fugitive.

It should be noted that in other non-limiting example embodiments, conical net 402 may be replaced with a flexible sheet such as made from fabric material or plastic with holes dispersed throughout.

Figure 5:
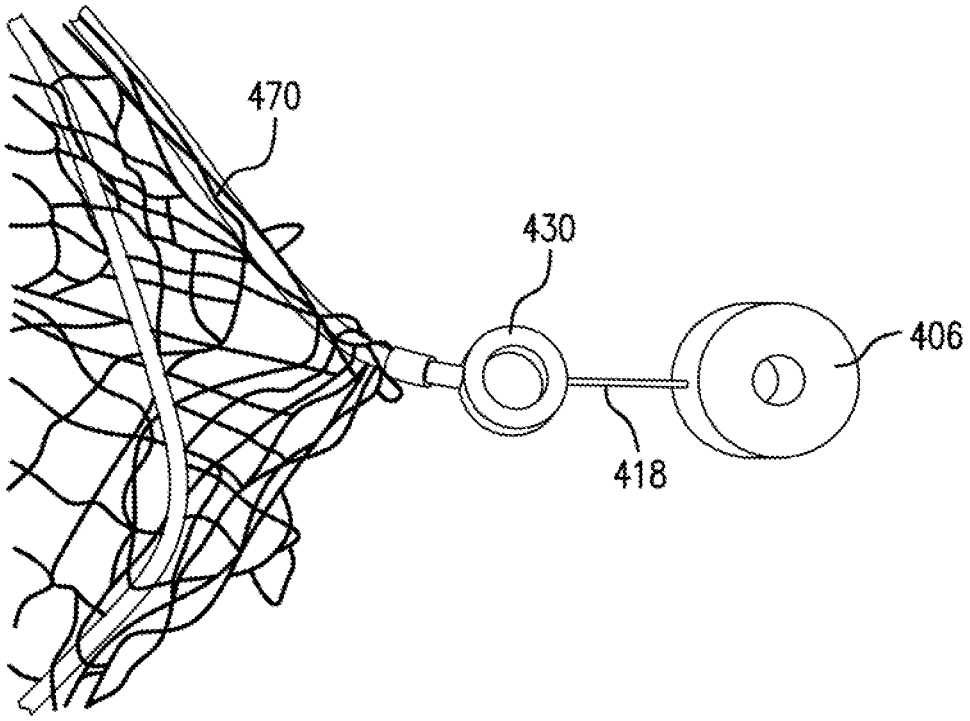
FIG. 5 illustrates an exploded view of a lateral weight of the example containment system of FIG. 1.

FIG. 5 illustrates an exploded view of lateral weight 406 of containment system 100.

Each of lateral weights 406, 408, 410, 412, 414 and 416 may be attached to one monofilament lines 418, 420, 422, 424, 426 and 428, respectively. Each of monofilament lines 418, 420, 422, 424, 426 and 428 passes through to one of weighted springs 430, 432, 434, 436, 438 and 440, respectively, and is attached to circumference 470 of conical net 402.

Alternatively, lateral weights 406, 408, 410, 412, 414 and 416 may be attached, directly or indirectly, to circumference 470 in other ways, as will be known by those skilled in the art.

Lateral weights 406, 408 and 410 are positioned on side 474 of circumference 470 spaced 45° apart and lateral weights 412, 414 and 416 are positioned on side 476 spaced 45° apart. Of course, each of side 474 and side 476 may have more or fewer lateral weights disposed symmetrically therearound without departing from the spirit or scope of the present invention.

Lateral weights 406, 408 and 410 will generally be pulled in a direction toward side 474 by the force applied by lateral weights 406, 408 and 410 from an outward thrust of deployment, as will be described in detail below. Similarly, lateral weights 412, 414 and 416 will generally be pulled in a direction toward side 476 by the force applied by lateral weights 412, 414 and 416 from an outward thrust of deployment, as will be described in detail below.

Lateral weights 406, 408, 410, 412, 414 and 416 are attached circumference 470 of conical net 402 by way of respective monofilament lines 418, 420, 422, 424, 426 and 428. As such, the spreading of lateral weights 406, 408, 410, 412, 414 and 416 fully opens conical net 402 over the fugitive when deployed.

Weighted springs 430, 432, 434, 436, 438 and 440 provide two functions. First, weighted springs 430, 432, 434, 436, 438 and 440 provide additional weight to assist in spreading open conical net 402 over the fugitive when deployed. Secondly, weighted springs 430, 432, 434, 436, 438 and 440 provide tension to the respective lateral weights 406, 408, 410, 412, 414 and 416 when containment system 100 is stored in a deployment system as will be described in greater detail below.

Figure 6:
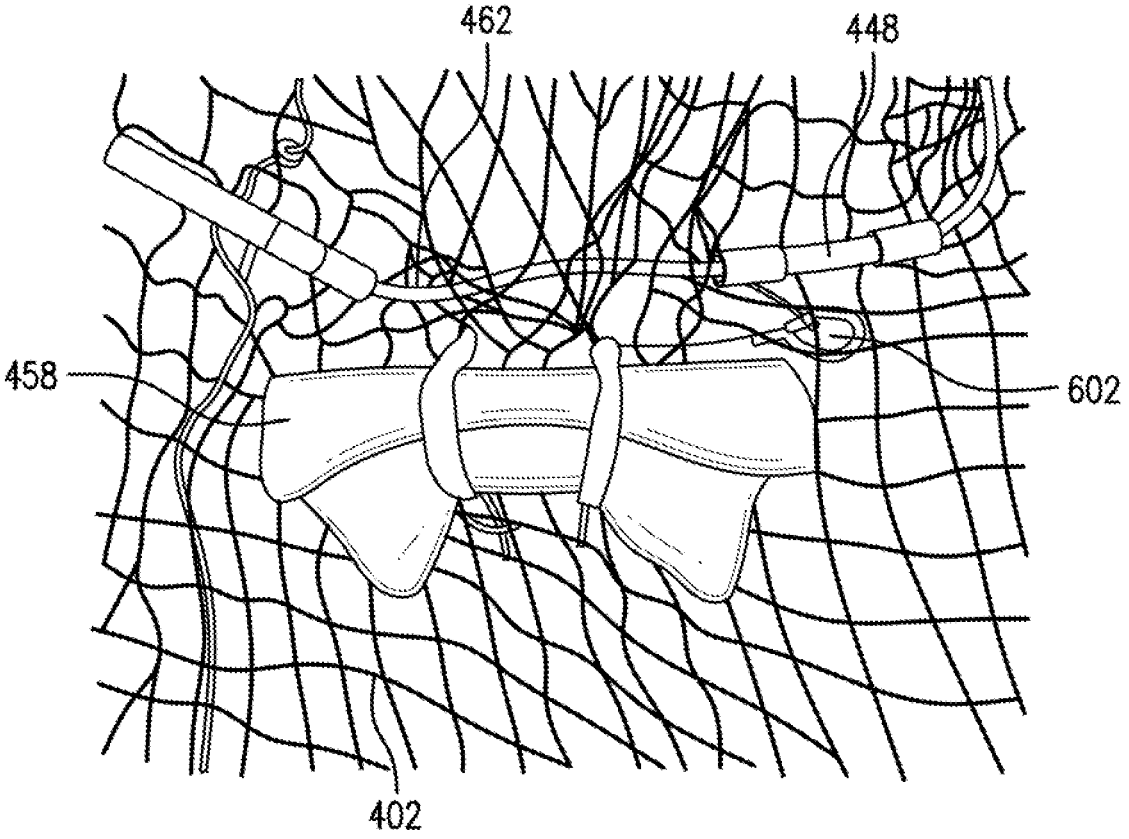
FIG. 6 illustrates an exploded view of a soft weight of the example containment system of FIG. 1.

FIG. 6 illustrates an exploded view of soft weight 458.

In an example embodiment, soft weights 458 and 460 are disposed on an axis that include center 472. Soft weight 458 has a tab 602 attached thereto, for detachable attachment to a deployment system, as will be described in greater detail below. Soft weight 460 (not shown) has a similar tab attached thereto, for detachable attachment to the deployment system.

Soft weights 458 and 460 are attached to conical net 402 at a position between center 472 and circumference 470 and equidistant between user end 102 and assistant end 106.

Soft weights 458 and 460 move forward when conical net 402 is deployed and stop their forward trajectory when conical net 402 and user cord extension 204 are stretched to their limit. That will be a position directly over the fugitive. Soft weights 458 and 460 will also be pulled to each side by the force to the lateral weights plus outward thrust of the deployment system since tab 181 and the tab for soft weight 460 (not shown) will be attached. The side load on soft weights 458 and 460 keeps center 472 of conical net 402 open so that conical net 402 does not get caught on the fugitive's shoulders.

As an analogy of the function of soft weights 458 and 460, imagine pulling on a long pair of socks, with the foot point into the air. In such a situation, the closed end of the sock would likely fall to one side or the other of the foot, making it hard to pull the sock totally onto the foot. To avoid this situation, a person might grab closer to the closed end of the sock, near the toes of the food to help slip the closed end of the sock totally onto the foot. In the case of soft weights 458 and 460, they help pull center 472 of conical net 402 over the head and shoulders of the fugitive.

Figure 7:
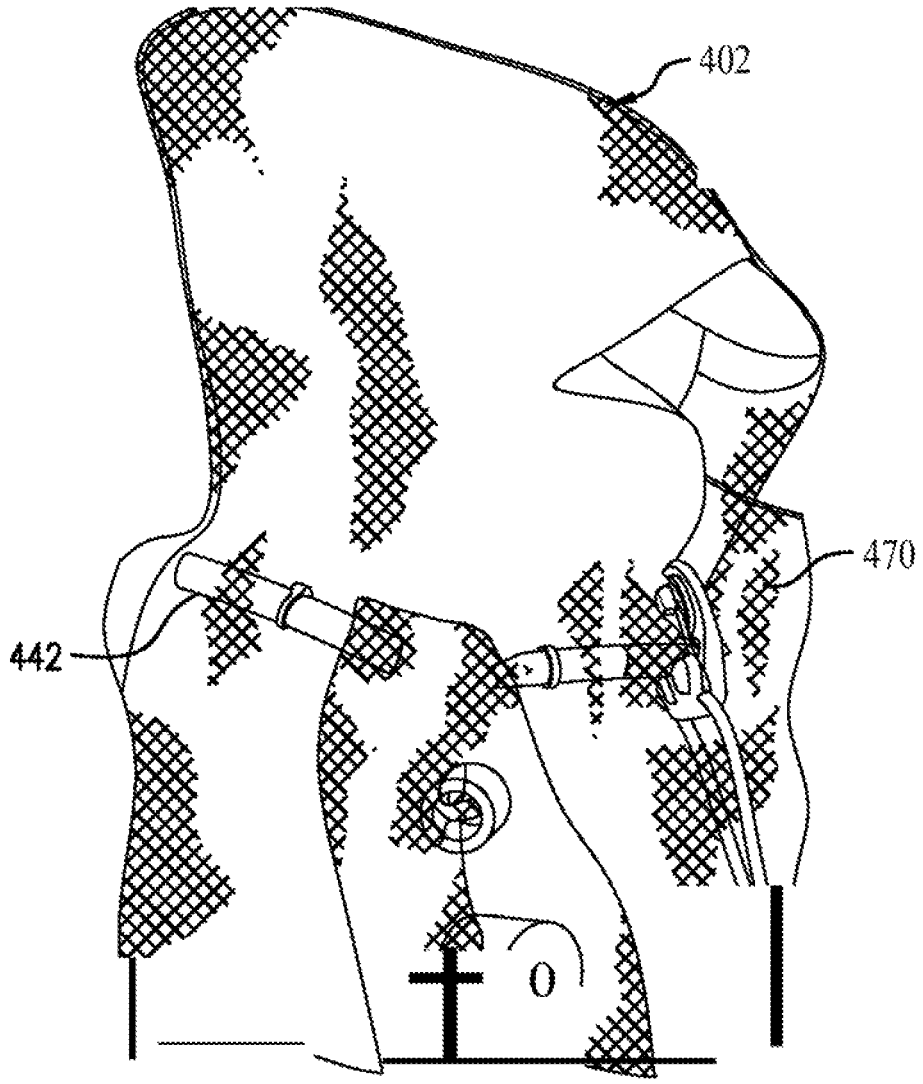
FIG. 7 illustrates an exploded view of spacer tubes of the example containment system of FIG. 1 when constricted.

FIG. 7 illustrates an exploded view of spacer tubes of containment system 100.

The plurality of spacer tubes, an example of which is labeled as spacer tube 442, are disposed around circumference 470. Any number of spacer tubes may be used. In an example embodiment, eight spacer tubes are included, wherein each is approximately 3 inches long. User cord 210 and an assistant cord pass through each of these spacer tubes.

The spacer tubes prevent conical net 402 from closing so tight as to choke the entrapped fugitive. For example, there may be an instance where conical net 402 fails to completely drape of the body of a fugitive or the fugitive tries to pull conical net 402 off, and only drapes around the head of the fugitive. If completely constricted without spacer tubes disposed around circumference 470, there is a chance that the fugitive might be choked. With the spacer tubes disposed around circumference 470 in accordance with aspects of the present invention, a constriction of conical net 402 limited to prevent such choking.

FIG. 7 illustrates an exploded view of a constricted conical net 402 with spacer tubes, preventing choking of a fugitive.

Another aspect of the present invention is drawn to mid-level hobble 462, which is used to restrict the ability of the fugitive to reach into their pants pockets.

Figure 8:
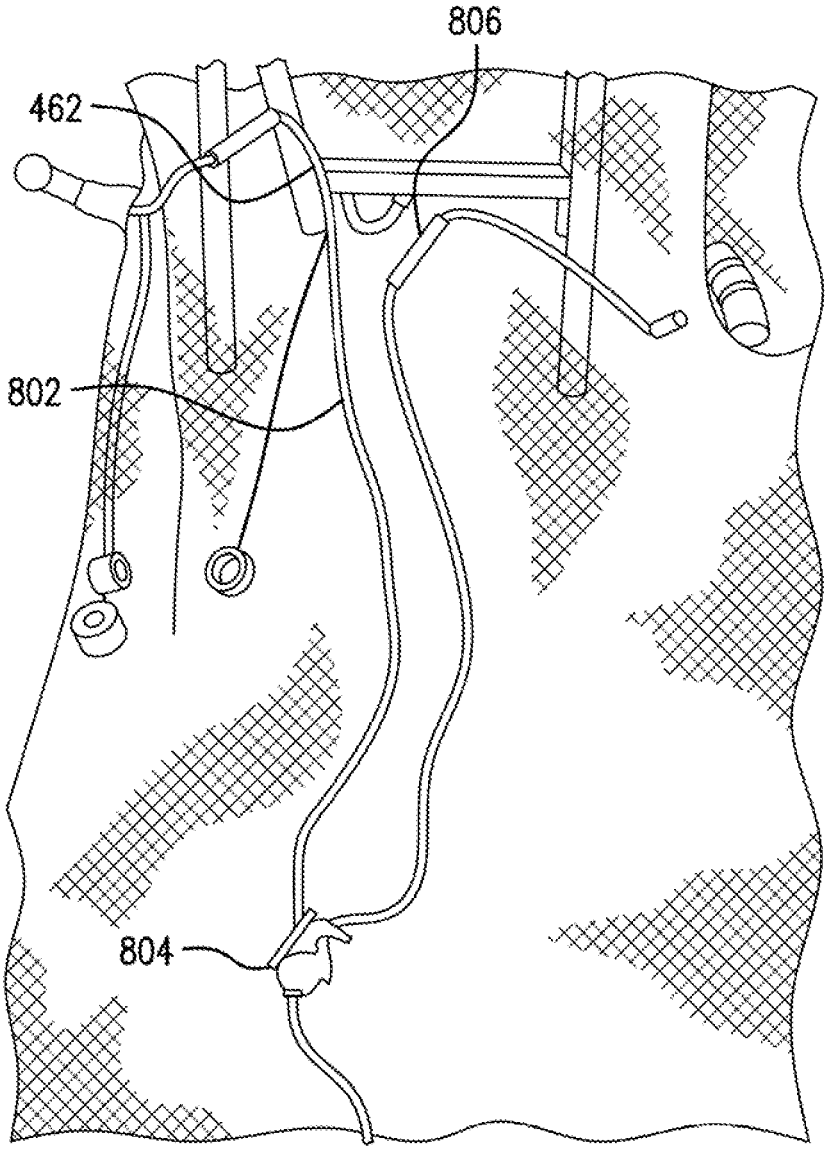
FIG. 8 illustrates an exploded view of a mid-level hobble of the example containment system of FIG. 1.

FIG. 8 illustrates an exploded view of mid-level hobble 462.

As shown in the figure, mid-level hobble 462 includes a mid-level hobble cord 802, a mid-level hobble lock 804 and a plurality of spacer tubes, a sample of which is indicated as spacer tube 806. Mid-level hobble cord 802 is disposed at a position between circumference 470 and center 472.

Mid-level hobble lock 804 may be any device or system that permits one-way movement of mid-level hobble cord 802. In an example embodiment, mid-level hobble lock 804 has the same structure as user one-way cord lock discussed above with reference to FIG. 3.

As shown in the figure, mid-level hobble cord 802 is attached to user handle 208 and passes through mid-level hobble lock 804. The cord enters the net at a point directly in front of user handle 208 (not shown) and mid-way between center 472 and circumference 470 conical net 402. Mid-level hobble cord 802 is associated with a full circle of conical net 402 in any known manner that will enable constriction of conical net 402. In an example embodiment, mid-level hobble cord 802 weaves in and out of both net openings and the plurality spacer tubes, including spacer tube 806. In an example embodiment, eight spacer tubes are used, each of which having a length three inches. The end of mid-level hobble cord 802 finishes where it started in conical net 402 and is attached to mid-level hobble lock 804. This configuration acts like a lasso to tighten around the waist of the fugitive.

Another aspect of the present invention is drawn to upper-level hobble 464, which is used to restrict the fugitive's arms.

Figure 9:
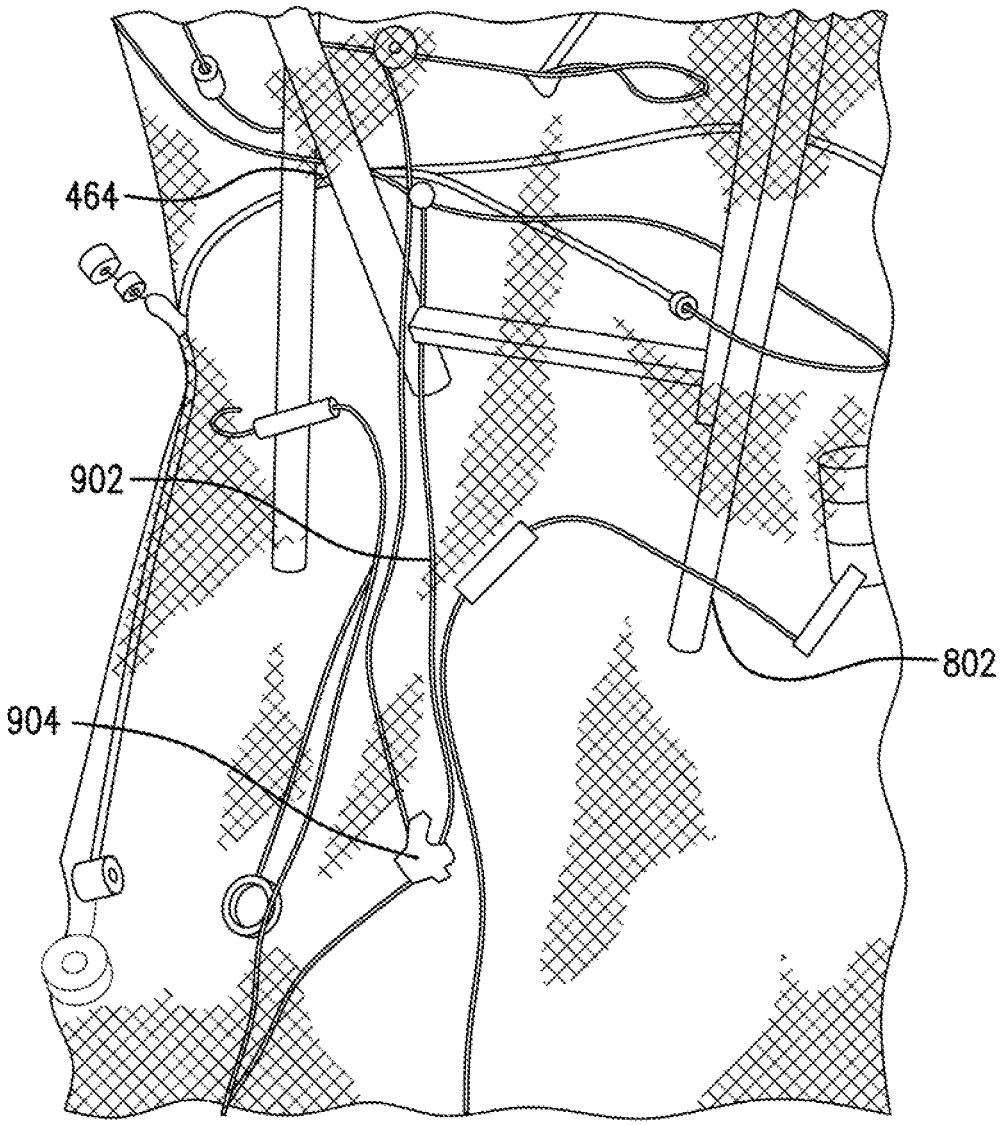
FIG. 9 illustrates an exploded view of an upper-level hobble of the example containment system of FIG. 1.

FIG. 9 illustrates an exploded view of upper-level hobble 464.

As shown in the figure, upper-level hobble 464 includes an upper-level hobble cord 902 and an upper-level hobble lock 904. Upper-level hobble cord 902 is disposed at a position between mid-level hobble cord 802 and center 472.

Upper-hobble lock 904 may be any device or system that permits one-way movement of upper-level hobble cord 902. In an example embodiment, upper-level hobble lock 904 has the same structure as user one-way cord lock discussed above with reference to FIG. 3.

As shown in the figure, the end of upper-level hobble cord 902 is not attached to anything. Upper-level hobble cord 902 passes through upper-level hobble lock 904 then enters conical net 402 approximately 12 inches above mid-level hobble lock 804. Upper-level hobble cord 902 is associated with a full circle of conical net 402 in any known manner that will enable constriction of conical net 402. In an example embodiment, upper-level hobble cord 902 weaves in and out of conical net 402 openings around circumference 470 staying 12 inches above mid-level hobble cord 802. The end of upper-level hobble cord 902 finishes where it started in conical net 402 and is attached to upper-level hobble lock 904. This configuration also acts like a lasso to tighten around the arms of the fugitive. Upper-level hobble 464 may be only used when the fugitive is thrashing around their arms.

Another aspect of the present invention is drawn to mid-level net release 466, which is used to open conical net 402 so that the officers can reach the fugitive's wrists to secure handcuff's.

Figure 10:
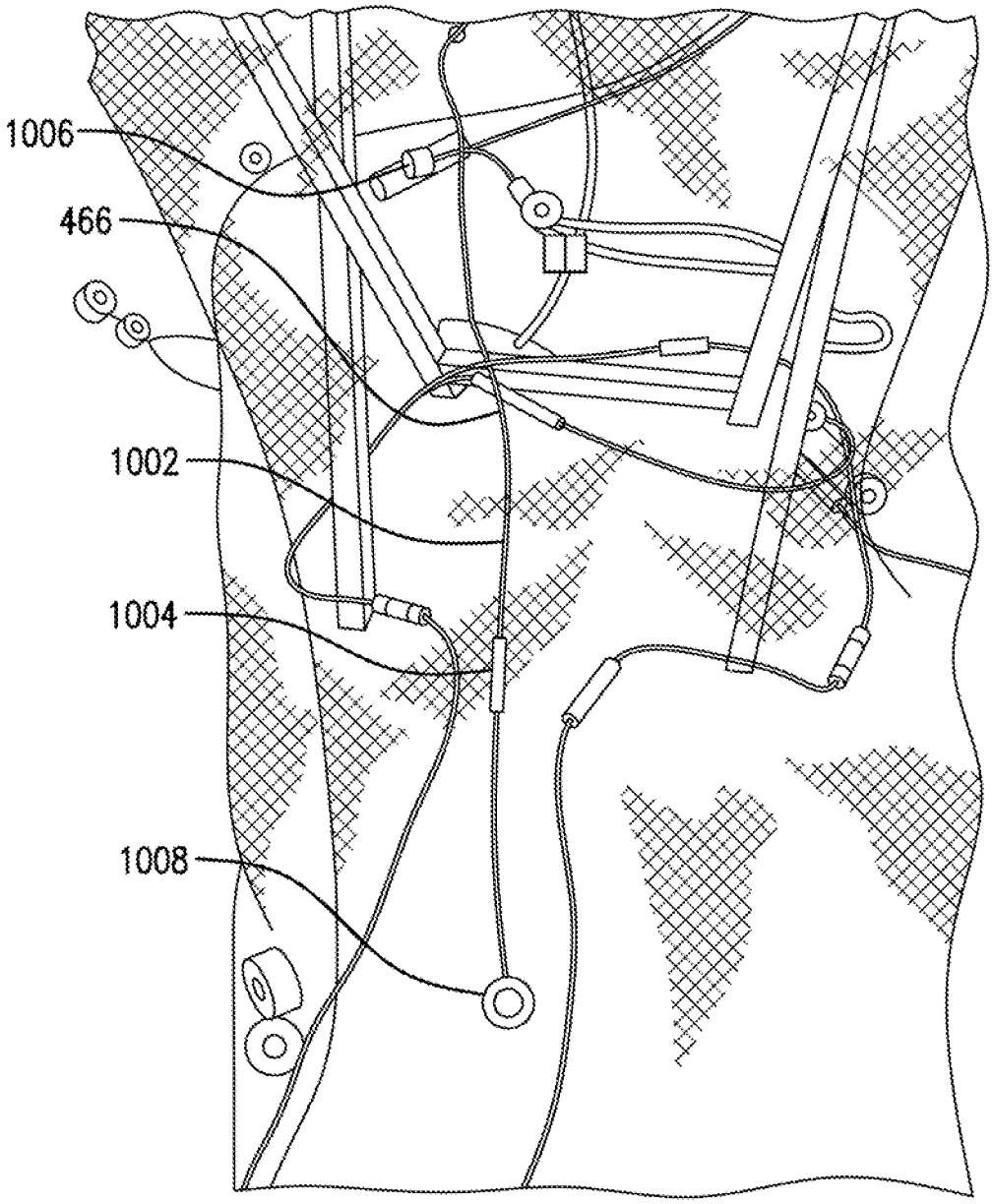
FIG. 10 illustrates an exploded view of a mid-level net release of the example containment system of FIG. 1.

FIG. 10 illustrates an exploded view of mid-level net release 466.

As shown in the figure, mid-level net release 466 includes a mid-level slit 1002, a mid-level release thread 1004, a mid-level release thread dip 1006 and a mid-level release thread grip 1008.

As shown in the figure, mid-level slit 1002 is disposed between center 472 and circumference 470. In an example embodiment, mid-level slit 1002 in conical net 402 is approximately two feet in length and runs from approximately six inches below mid-level hobble lock 804 to approximately six inches above upper-level hobble lock 904. In an example embodiment, mid-level release thread grip 1008 and mid-level release thread clip 1006 are the same color for ease of operation. Mid-level release thread clip 1006 is attached to conical net 402 at a point next to the base of mid-level slit 1002. Mid-level release thread 1004 is secured by mid-level release thread clip 1006 and then weaves through openings of conical net 402 along mid-level slit 1002 so that mid-level slit 1002 is closed. The top of the mid-level release thread 1004 is terminated in mid-level release thread grip 1008, which is located on the outside of conical net 402 and is too large to go through the openings in conical net 402.

It should be noted that mid-level slit 1002, mid-level release thread 1004, mid-level release thread clip 1006 and mid-level release thread grip 1008 may be replaced with a zipper or other such system, as will be apparent to those skilled in the art.

Another aspect of the present invention is drawn to upper-level net release 468, which is used to open conical net 402 so that the officers can remove conical net 402 from the fugitive.

Figure 11:
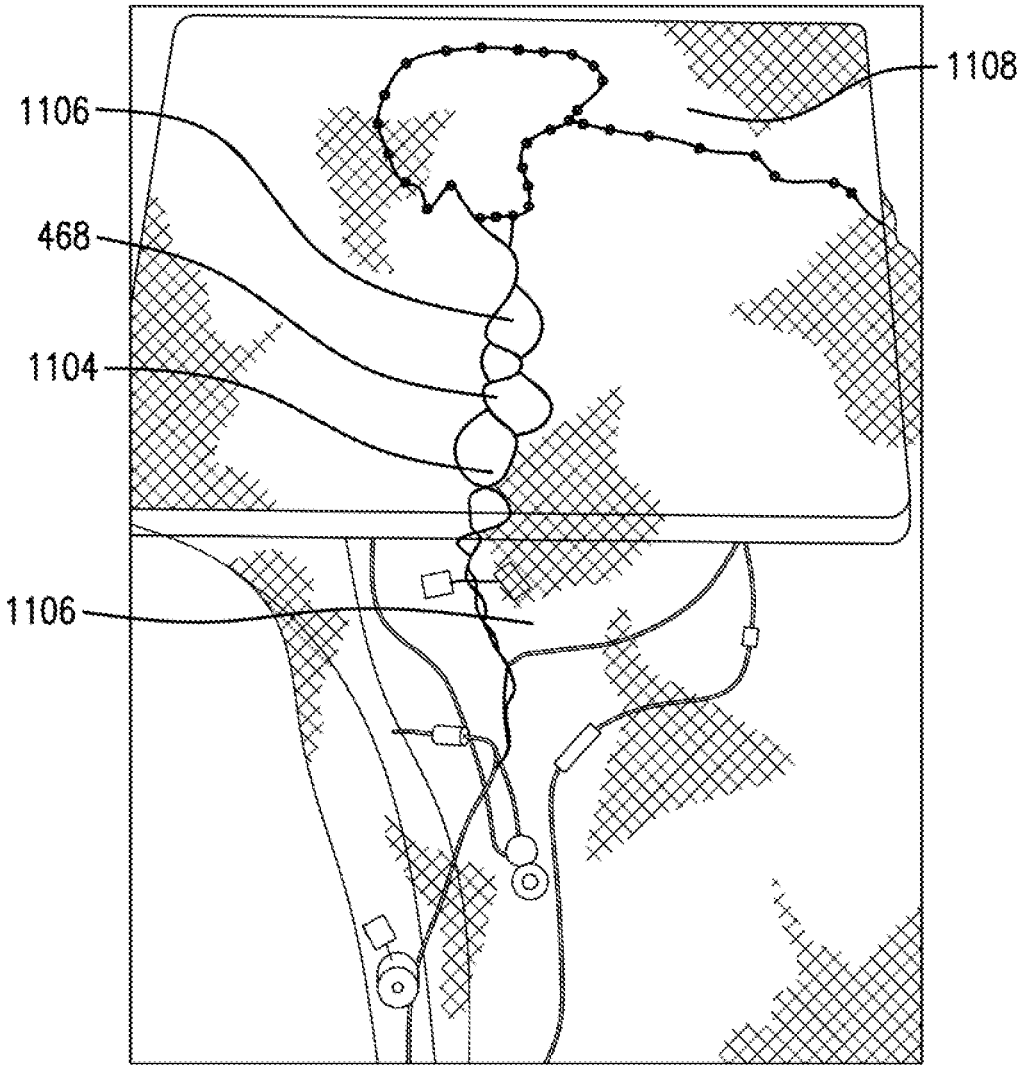
FIG. 11 illustrates an exploded view of an upper-level net release of the example containment system of FIG. 1.

FIG. 11 illustrates an exploded view of upper-level net release 468.

As shown in the figure, upper-level net release 468 includes an upper-level slit 1102, an upper-level release thread 1104, an upper-level release thread clip 1106 and an upper-level release thread grip 1108.

Upper-level slit 1102 is disposed from center 472 to a position between center 472 and circumference 470. In an example embodiment, upper-level slit 1102 runs from the top of mid-level slit 1002 to center 472 of conical net 402. In an example embodiment, upper-level release thread grip 1108 and upper-level release thread clip 1106 are the same color for ease of operation. Upper-level release thread clip 1106 is attached to conical net 402 at a point near to mid-level release thread grip 1008. Upper-level release thread 1104 is secured by upper-level release thread clip 1106 and then weaves through the openings of conical net 402 along upper-level slit 1102 so that upper-level slit 1102 is closed. The top of upper-level release thread 1104 is terminated in upper-level release thread grip 1108, which is located on the outside of conical net 402 and is too large to go through the openings in conical net 402.

It should be noted that upper-level slit 1102, upper-level release thread 1104, upper-level release thread clip 1106 and upper-level release thread grip 1108 may be replaced with a zipper system.

Figure 12:
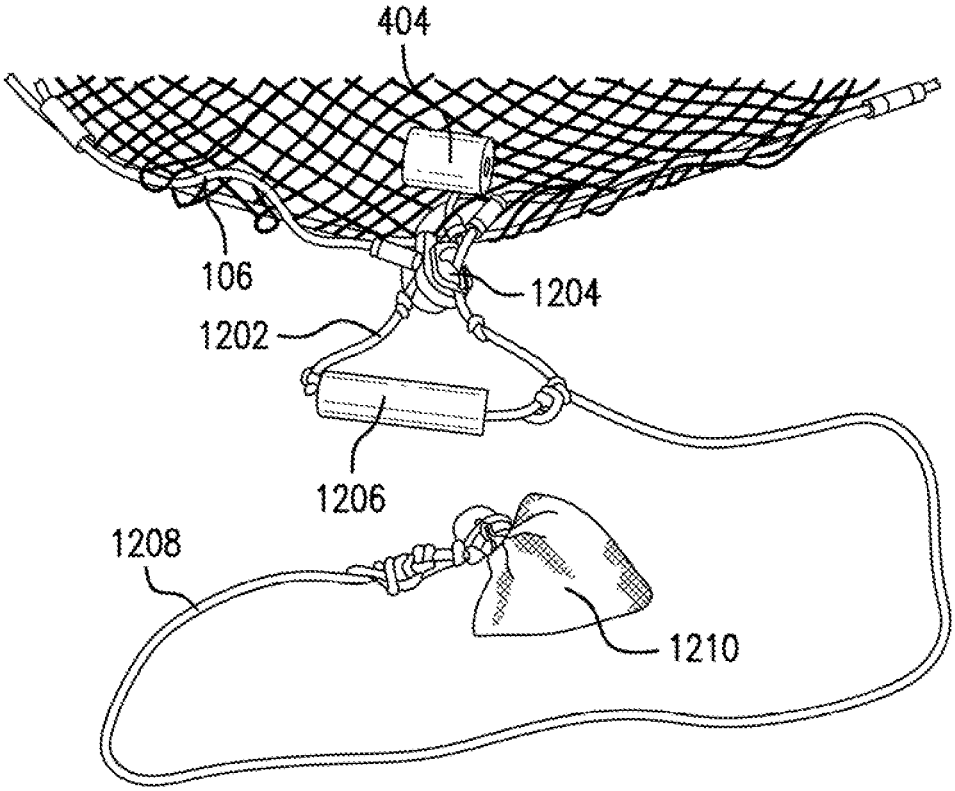
FIG. 12 illustrates an exploded view of an assistant end of the example containment system of FIG. 1.

FIG. 12 illustrates an exploded view of assistant end 1136.

As shown in the figure, assistant end 106 includes an assistant cord 1202, an assistant one-way cord lock 1204, an assistant handle 1206, an assistant handle extension 1208 and an assistant handle weight 1210.

Assistant handle weight 1210 will generally be pushed away from user end by the force applied by handle weight 1210 from an outward thrust of deployment, as will be described in detail below. Assistant handle weight 1210 provides an additional manner for an assistant to grip assistant end 106 once deployed.

Adjacent to assistant one-way cord lock 1204 is primary weight 404, which in some embodiments has a soft covering, and which is attached to conical net 402.

Assistant handle extension 1208 provides an extension from assistant handle weight 1210 to assistant handle 1206. In an example embodiment, assistant handle extension 1208 provides approximately a three foot extension from assistant handle weight 1210 to assistant handle 1206. This extension allows the assistant to grab assistant handle weight 1210 at a safe distance from the fugitive. If an assistant initially grips assistant handle weight 1210, the assistant may use assistant handle extension 1208 to easily grip user handle 1206.

Assistant handle 1206 enables the assistant to quickly find and grasp assistant cord 1202. It should be noted that assistant handle 1206 is not required. However, assistant handle 1206 reduces the strain on the assistant's hands.

Assistant cord 1202 extends from assistant handle 1206, around central portion 104 and back to assistant handle 1206. When pulled by assistant handle 1206, assistant cord 1202 constricts central portion 104, as will be discussed in greater detail below.

Assistant one-way cord lock 1204 may be any device or system that permits one-way movement of assistant cord 1202 and that includes an unlocking mechanism to enable two-way movement. In an example embodiment, assistant one-way cord lock 1204 has the same structure as user one-way cord lock discussed above with reference to FIG. 3.

User one-way cord lock 212 and assistant one-way cord lock 1204 are attached to circumference 470 of conical net 402, so as to be separated from one another by approximately 180°. User cord 210 and assistant cord 1202 run adjacent to each other around circumference 470 of conical net 402. User cord 210 and assistant cord 1202 are associated with circumference 470 of conical net 402 in any known manner that will enable constriction of conical net 402. In some embodiments, user cord 210 and assistant cord 1202 weave around circumference 470 of conical net, each looping in and out of adjacent net openings. In some embodiments, user cord 210 and assistant cord 1202 are disposed through tubes or rings that are attached around circumference 470 of conical net.

Assistant handle extension 1208 and assistant handle weight 1210 are attached to assistant handle 1206. This provides additional distance between the assisting officer and the fugitive when containment system 100 is deployed.

An example deployment system 1300 for deploying containment system 100 in accordance with aspects of the present invention will now be described with reference to FIGS. 14-21.

Figure 13:
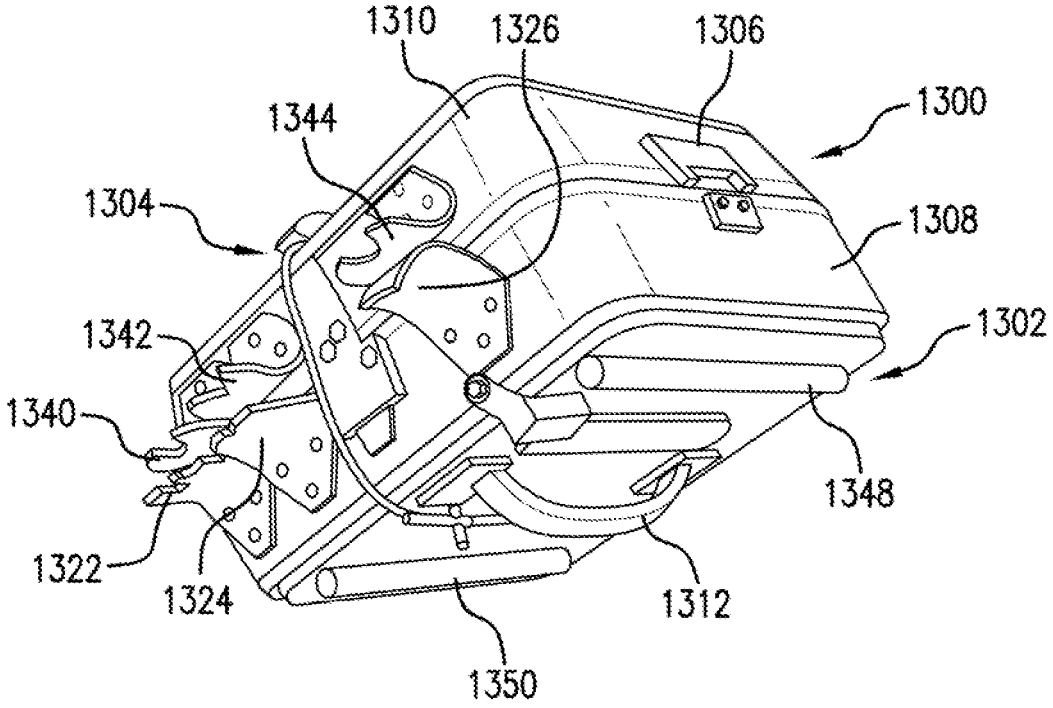
FIG. 13 illustrates an example deployment system in accordance with aspects of the present invention.

FIG. 13 illustrates example deployment system 1300 in accordance with aspects of the present invention.

Deployment system 1300 includes a targeting system 1302, a securing mechanism 1304, a quick release slot 1306, a left shell 1308 and a right shell 1310. Left shell 1308 includes: a left grip 1312; left alignment tabs 1314, 1316, 1318 and 1320; left launch pads 1322, 1324 and 1326; and a left soft weight spring clip 1328 (not shown). Right shell 1310 includes: a right grip 1330 (not shown); right alignment tabs 1332, 1334, 1336 and 1338; right launch pads 1340, 1342 and 1344; and right soft weight spring clip 1346 (not shown).

Targeting system 1302 may be any system or device that is able to indicate to a user a predetermined distance from the fugitive for which the user should be standing to deploy containment system 100. In an example embodiment, a user should be approximately eight feet away from a fugitive when containment system 100 is deployed. This eight foot distance enables a short flight time of containment system, while concurrently maintaining distance from the fugitive. In some embodiments, the predetermined distance may be adjusted by any known system or method.

In an example embodiment, targeting system 1302 includes a laser 1348 and a laser 1350. Laser 1348 and laser 1350 may be mounted to either of left shell 1308 or right shell 1310 in a parallel or non-parallel manner. In particular, laser 1348 and laser 1350 may be mounted such that a laser beam from laser 1348 converges with a laser beam from laser 1350 at the predetermined distance. In this light, it should be noted that some embodiments would include an adjustment mechanism to adjust the relative angle between laser 1348 and laser 1350 so as to adjust the predetermined distance.

Containment system 100 is carried in a deployment system 1300. Securing mechanism 1304 may be any device or system that secures left shell 1308 to right shell 1310. In an example embodiment, securing mechanism includes a bungee cord having one end attached to one of left grip 1312 and right grip 1330 and a second and having a hook that hooks onto the other of right grip 1330 and left grip 1312.

Quick release slot 1306 may be any system or device that is able to detachably attach to attaching portion 506 of breakaway shoulder strap 202. In an example embodiment, attaching portion 506 is a male shaped item, whereas quick release slot 1306 is a female shaped slot arranged to receive attaching portion 506.

Each of left grip 1312 and right grip 1330 may be any device that enables a user to hold left shell 1308 and right shell 1310, respectively, and to pull left shell 1308 from said right shell 1310 so as to release containment system 100.

Figure 14:
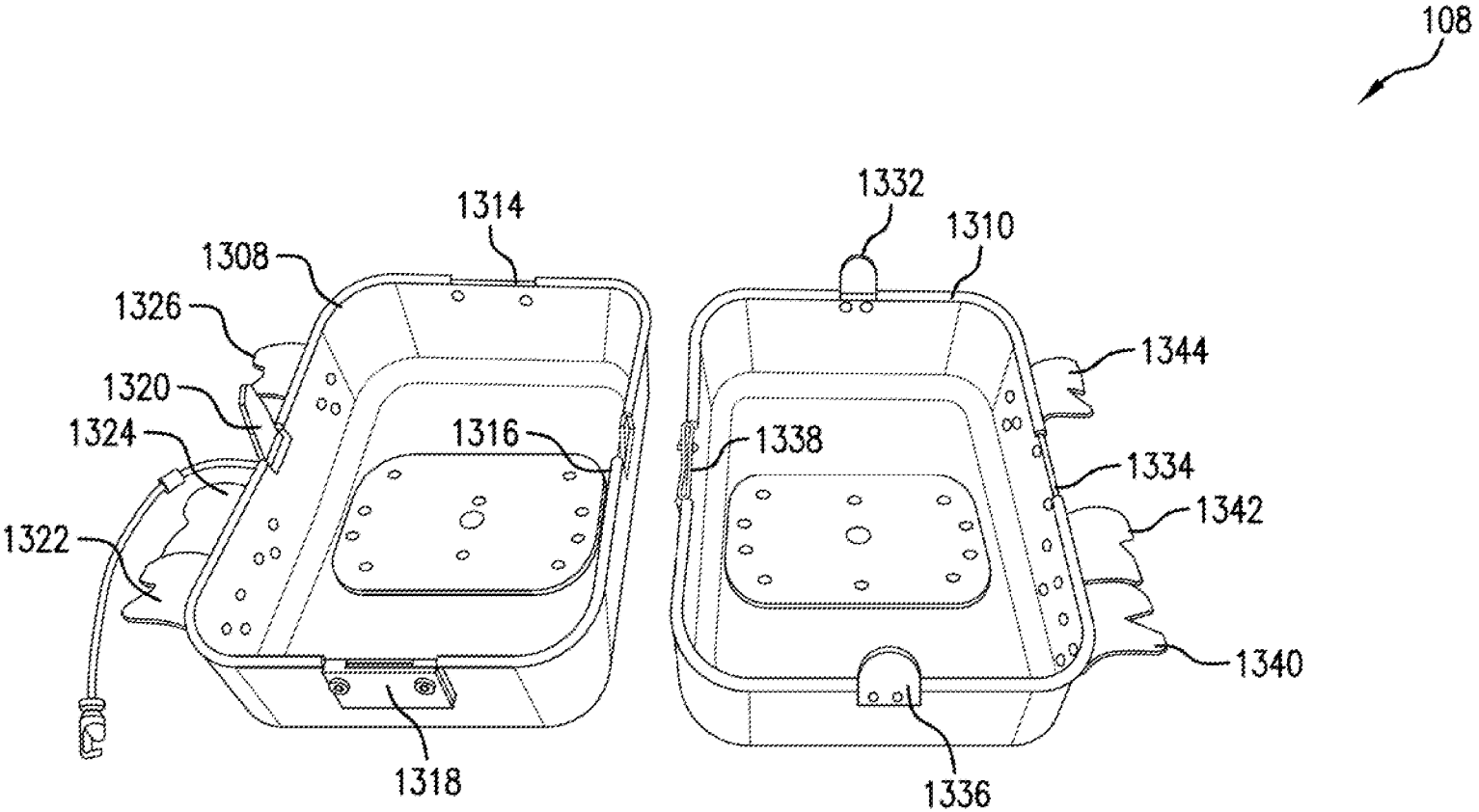
FIG. 14 illustrates the deployment system of FIG. 13 in an opened state.

FIG. 14 illustrates deployment system 1300 in an opened state.

Left alignment tabs 1314, 1316, 1318 and 1320 and right alignment tabs 1332, 1334, 1336 and 1338 may be any known form that enables left shell 1308 to mate with right shell 1310, but maintain an easy disengagement between left shell 1308 and right shell 1310. In some example embodiments, left alignment tabs 1314, 1316, 1318 and 1320 are a female form designed to receive and right alignment tabs 1332, 1334, 1336 and 1338, which have a corresponding male form. In some example embodiments, left alignment tabs 1314, 1316, 1318 and 1320 are a male form designed to insert into right alignment tabs 1332, 1334, 1336 and 1338, which have a corresponding female form. In some example embodiments, some of left alignment tabs 1314, 1316, 1318 and 1320 are a female form designed to receive and corresponding number of right alignment tabs 1332, 1334, 1336 and 1338, which have a corresponding male form, and the remaining portion of left alignment tabs 1314, 1316, 1318 and 1320 are a male form designed to insert into a corresponding number of right alignment tabs 1332, 1334, 1336 and 1338, which have a corresponding female form.

Figure 15:
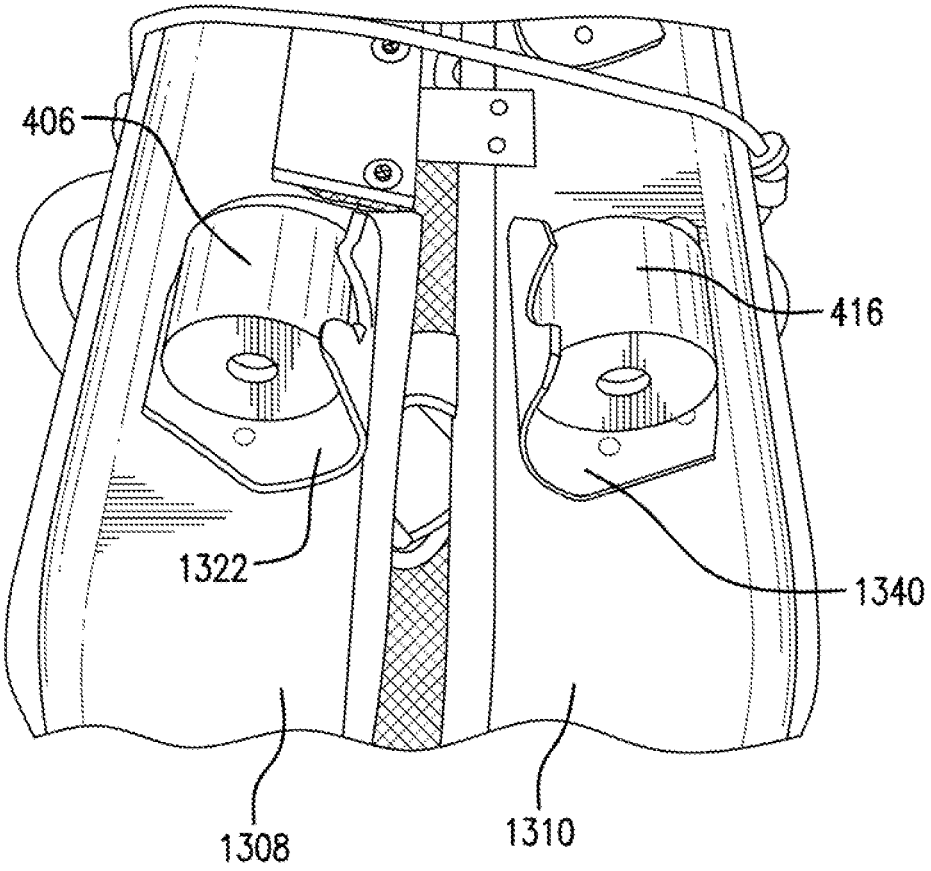
FIG. 15 illustrates an exploded view of a launch pad of the deployment system of FIG. 13.

FIG. 15 illustrates an exploded view of launch pad 1322 and launch pad 1340.

A launch pad, e.g., launch pad 1322, may be any device or system that can receive a lateral weight and that can direct a velocity of the lateral weight in a direction to encourage the opening of conical net 402. In deployment system 1300 a single launch pad is designed and arranged to receive a single lateral weight by way of a single line notch. However, in other non-limiting example embodiments, a single launch pad may have a plurality of line notches to receive a plurality of lateral weights. Further, in other non-limiting example embodiments, a single launch bad may have a plurality of line notches to receive a single lateral weight in one of a plurality of positions.

Figure 16:
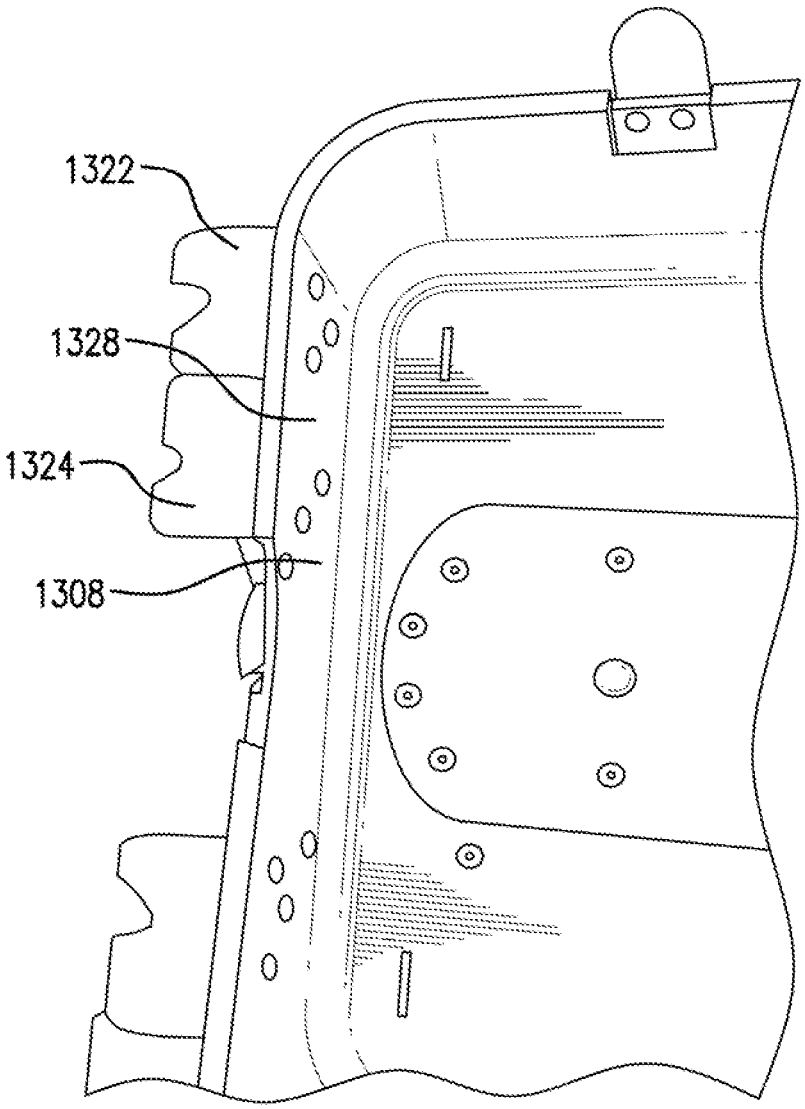
FIG. 16 illustrates an exploded view of a left soft weight spring clip of the deployment system of FIG. 13.

FIG. 16 illustrates an exploded view of left soft weight spring clip 1328.

Left soft weight spring clip 1328 and right soft weight spring clip 1346 may be any device or system that is able to detachably retain soft weight tabs 181 and 182 of soft weights 458 and 460.

Left shell 1308 is arranged to mate with right shell 1310. In an example embodiment, alignment tabs 1314, 1316, 1318 and 1320 of left shell 1308 and alignment tabs 1332, 1334, 1336 and 1338 of right shell 1310 keep left shell 1308 aligned with right shell 1310 when deployment system 1300 is closed. The inside of deployment system 1390 is open and smooth so that conical net 402 will not snag on any edges.

The placement of containment system 100 in deployment system 1300 is most important to prevent snags and tangles. An example method of placement of containment system 100 in deployment system 1300 will now be described with reference to FIGS. 17-20.

Figure 17:
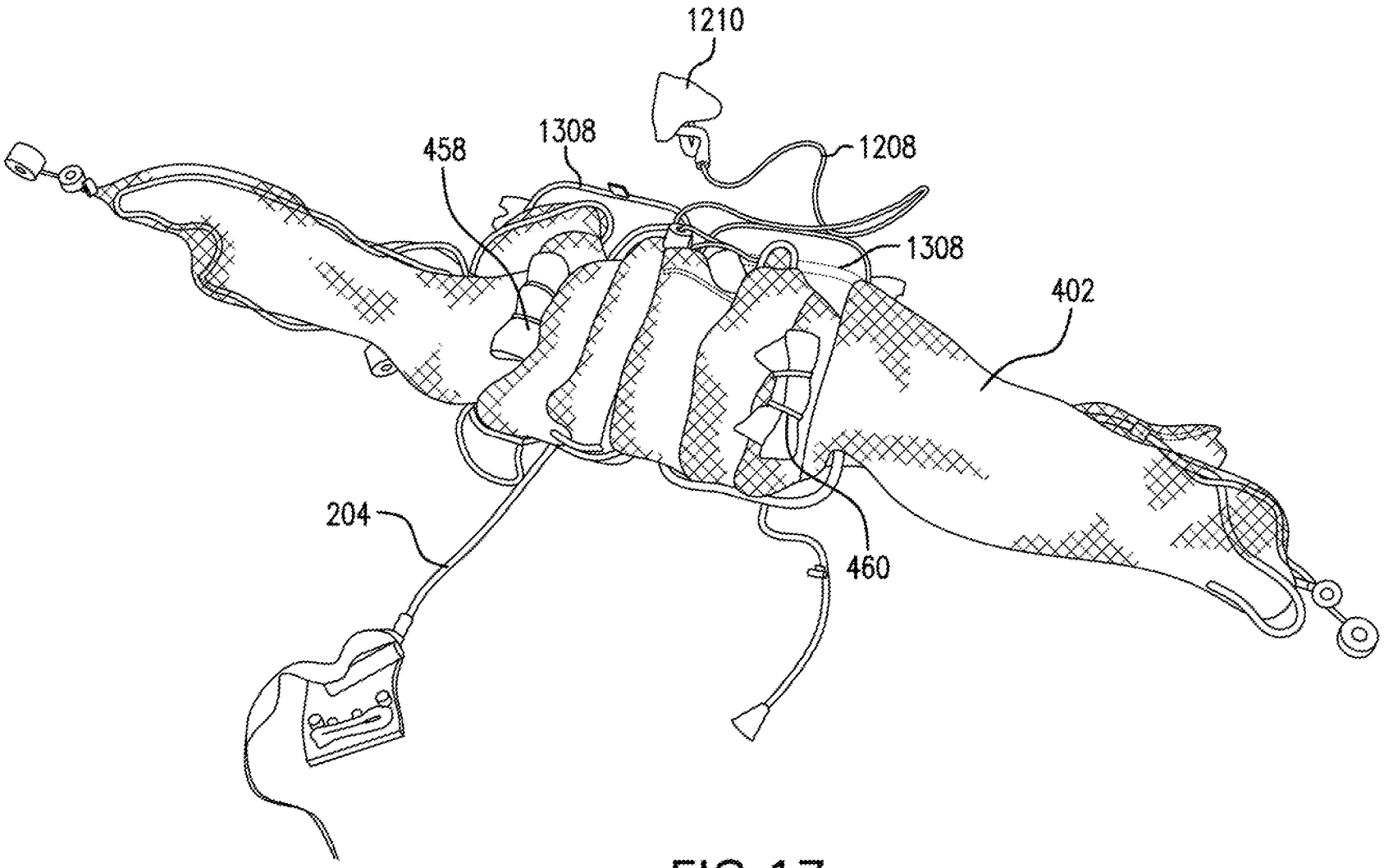
FIG. 17 illustrates a first step of placement of the containment system of FIG. 1 in the deployment system of FIG. 13.

FIG. 17 illustrates a first step of placement of containment system 100 in deployment system 1300.

As shown in the figure, the first step is to place left shell 1308 and right shell 1310 side by side such that launch pads 1362, 1324 and 1326 of left shell 1308 are furthest from launch pads 1340, 1342 and 1344 of right shell 1310. Conical net 402 is laid flat on the ground with the up-facing left shell 1308 disposed at user end 102. Start placing containment system 100 by putting user handle 208 and cord stop 206 in right shell 1310. User cord extension 204 remains outside of deployment system 1300.

Figure 18:
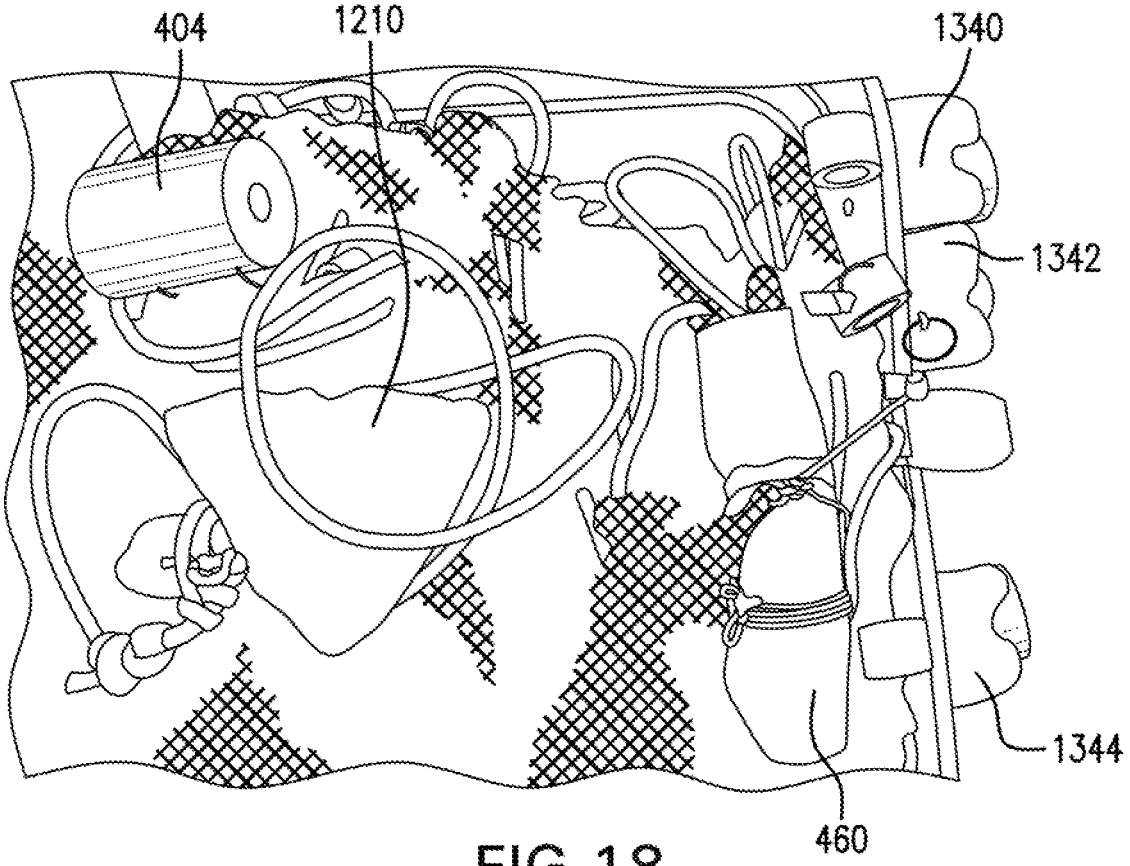
FIG. 18 illustrates a following step of placement of the containment system of FIG. 1 in the deployment system of FIG. 13.

FIG. 18 illustrates a following step of placement of containment system 100 in deployment system 1300.

As shown in the figure, the portion of conical net 402 that extends beyond left shell 1308 and right shell 1310 are folded in an accordion fashion on top of the portion of conical net 402 that is already placed in left shell 1308 and right shell 1310. Then conical net 402 is layered from each side towards the middle in an accordion configuration until lateral weights 406, 408 and 410 are left outside of left shell 1308, whereas lateral weights 412, 414 and 416 are left outside of right shell 1310. At left shell 1308, lateral weight 406 is aligned with launch pad 1362, lateral weight 408 is aligned with launch pad 1324 and lateral weight 410 is aligned with launch pad 1326. At right shell 1310, lateral weight 412 is aligned with launch pad 1340, lateral weight 414 is aligned with launch pad 1342 and lateral weight 416 is aligned with launch pad 1344.

Primary weight 404, assistant one-way cord lock 1204 and assistant handle 1206 are placed on top of conical net 402 in the middle front of the pile. Soft weights 458 and 460 are laid on top of conical net 402 and the soft weight tabs 181 and 182 are attached to soft weight spring clips 1328 and 1346 respectively.

Lateral weights 406, 408, 410, 412, 414 and 416 are placed within their respective launch pads. Monofilament lines 418, 420, 422, 424, 426 and 428 are placed in their respective grooves. Weighted springs 430, 432, 434, 436, 438, and 440 are disposed within left shell 1308 and right shell 1310 so as to provide tension on monofilament lines 418, 420, 422, 424, 426 and 428, which in turn provide tension on lateral weights 406, 408, 410, 412, 414 and 416, to keep lateral weights 406, 408, 410, 412, 414 and 416 within their respective launch pads.

Then assistant handle 1206 and assistant handle weight 1210 are placed on top of layered conical net 102. It is beneficial if conical net 102 is layered from side to side as opposed to top to bottom. This will increase the spread of lateral weights 406, 408, 410, 412, 414 and 416 during deployment.

Figure 19:
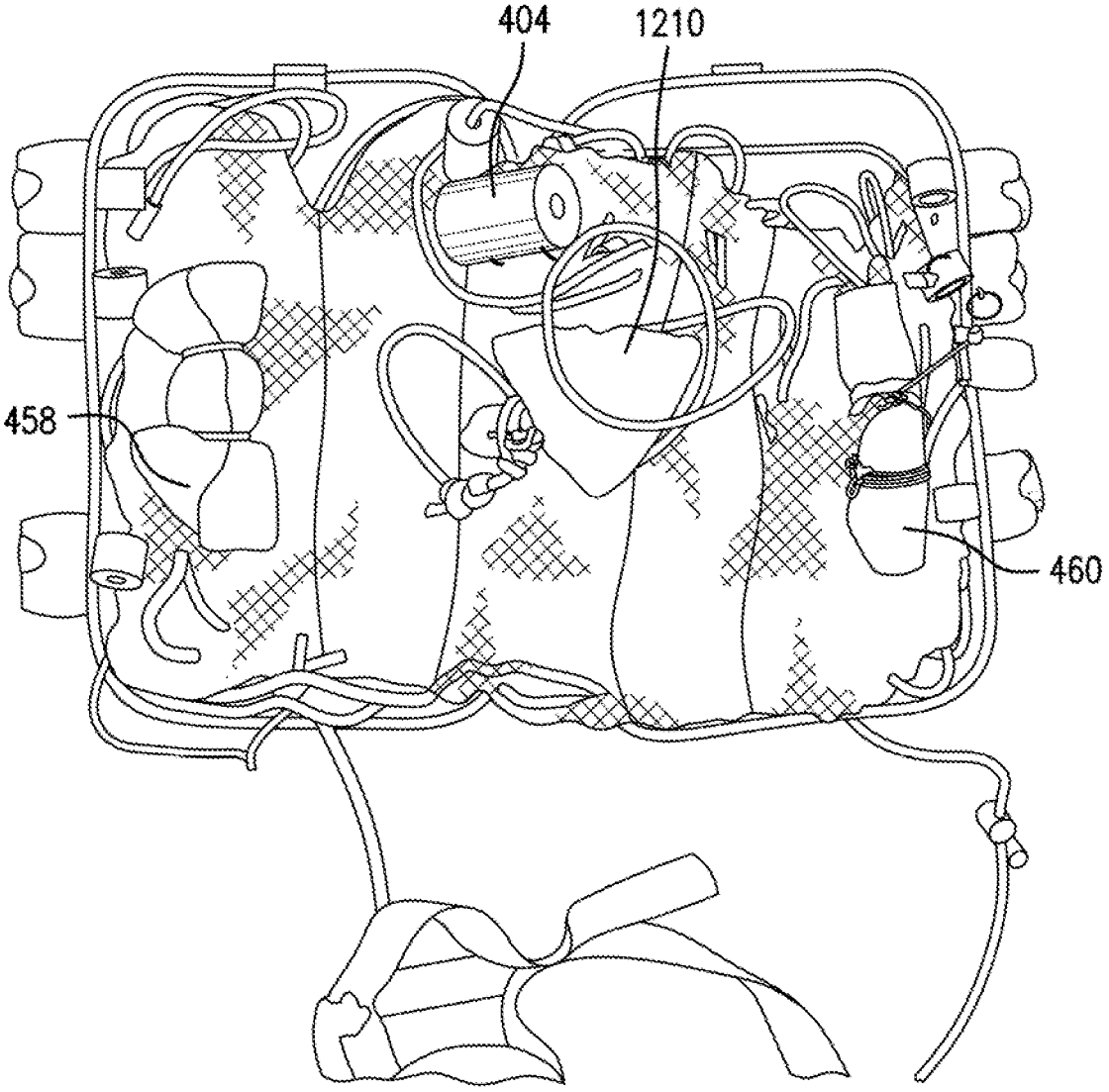
FIG. 19 illustrates a final step of placement of the containment system of FIG. 1 in the deployment system of FIG. 13.

FIG. 19 illustrates a final step of placement of containment system 100 in deployment system 1300.

As shown in the figure, left shell 1308 and right shell 1310 are closed together. In an example embodiment securing mechanism 1304 is a bungee cord or other similar device having one end affixed to left shell 1308 a releasable trigger on the other end, wherein the releasable trigger may be affixed to right shell 1310.

Figure 20:
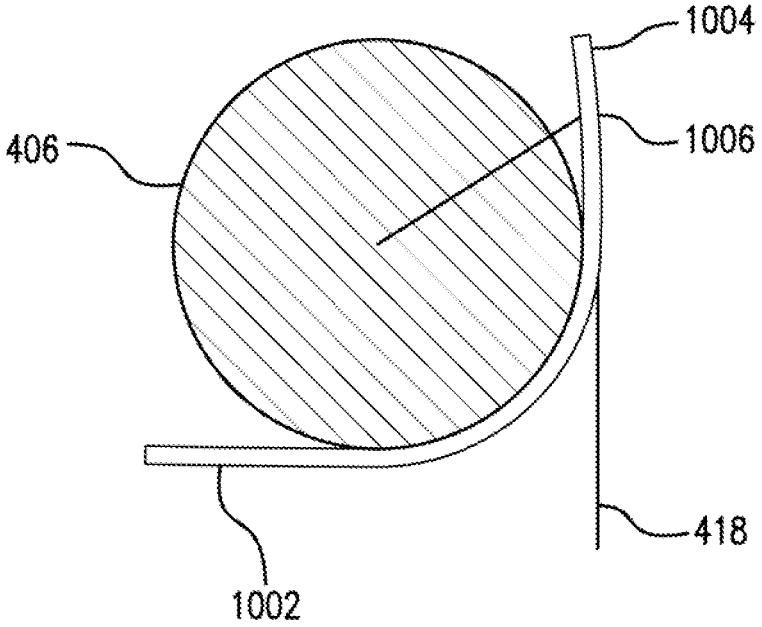
FIG. 20 illustrates a lateral t weight disposed within a lateral weight receiving groove.

When containment system 100 is correctly placed in deployment system 1300, each of lateral weights 406, 408, 410, 412, 414 and 416 are located in the outside cavity of their respective launch pad and the respective monofilament line is placed in the lateral weight receiving groove of the launch pad. For example as shown in FIG. 20, lateral weight 406 is disposed within lateral weight receiving groove 1002. Deflecting wall 1004 has monofilament line notch 1006 to receive monofilament line 418.

Weight springs 430, 432, 434, 436, 438 and 440 are compressed and pushed between left shell 1308 and right shell 1310. The closed left shell 1308 and right shell 1310 hold the springs 430, 432, 434, 436, 438 and 440 in place. Due to the compression of springs 430, 432, 434, 436, 438 and 440, lateral weights 406, 408, 410, 412, 414 and 416 will remain in place within respective launch pads 1362, 1324, 1326, 1340, 1342 and 1344.

Alignment tabs 1314, 1316, 1318 and 1320 of left shell 1308 are mated with alignment tabs 1332, 1334, 1336 and 1338 of right shell 1310. Any known system or method of alignment may be employed in accordance with aspects of the present invention. The deployment system 1300 is now ready to deploy containment system 100.

A method of deploying containment system 100 from deployment system 1300 will now be described with additional reference to FIGS. 21-39.

Figure 21:
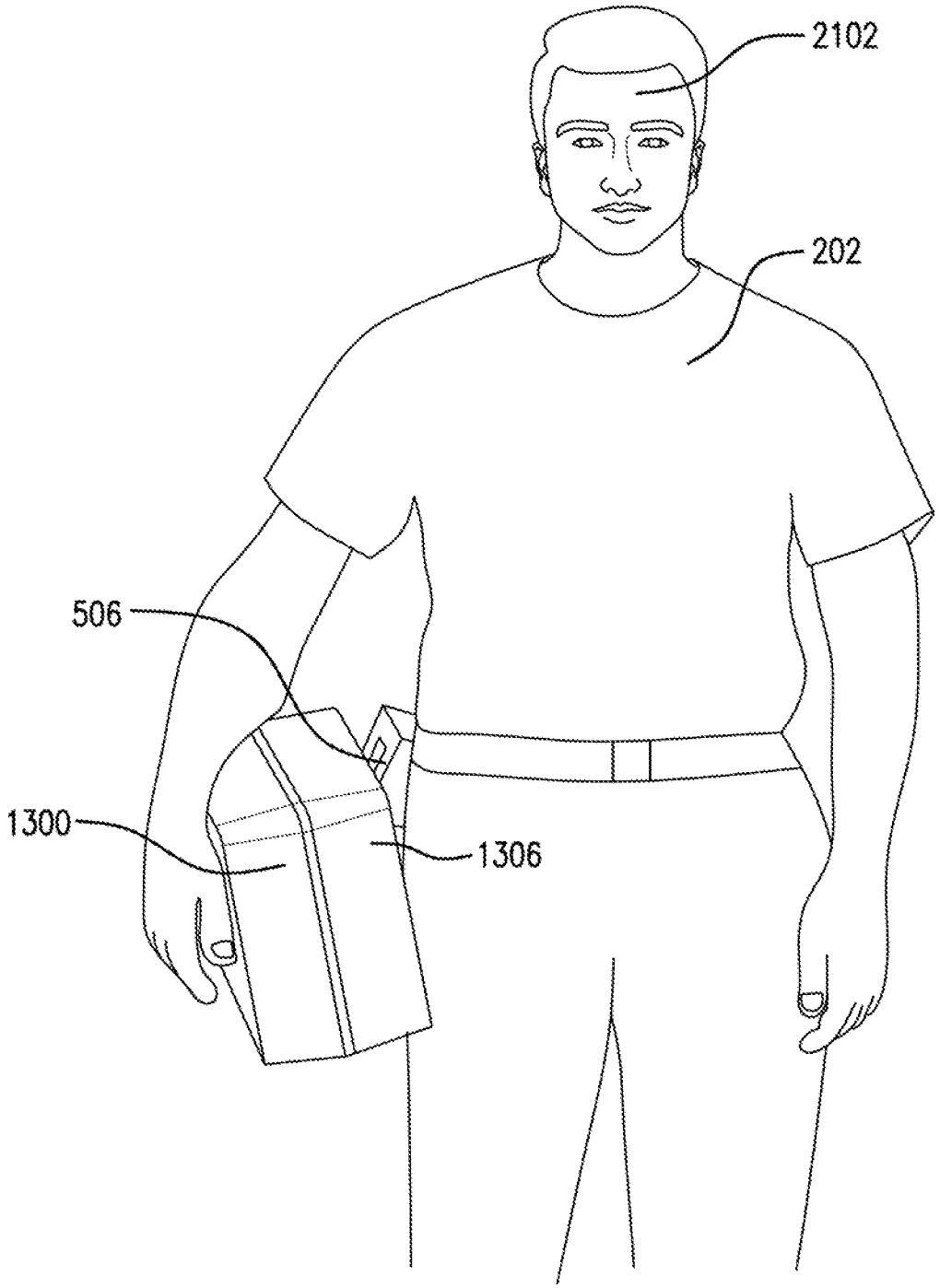
FIG. 21 illustrates an officer with the deployment system of FIG. 13.

FIG. 21 illustrates an officer 2102 with deployment system 1300.

Officer 2102 with quick release slot 1306 secured to attaching portion 506. User cord extension 204 is attached to the shoulder strap 202. User cord extension 204 can be adjusted to a set length which will determine the proper distance between officer 2102 and the fugitive.

Figure 22:
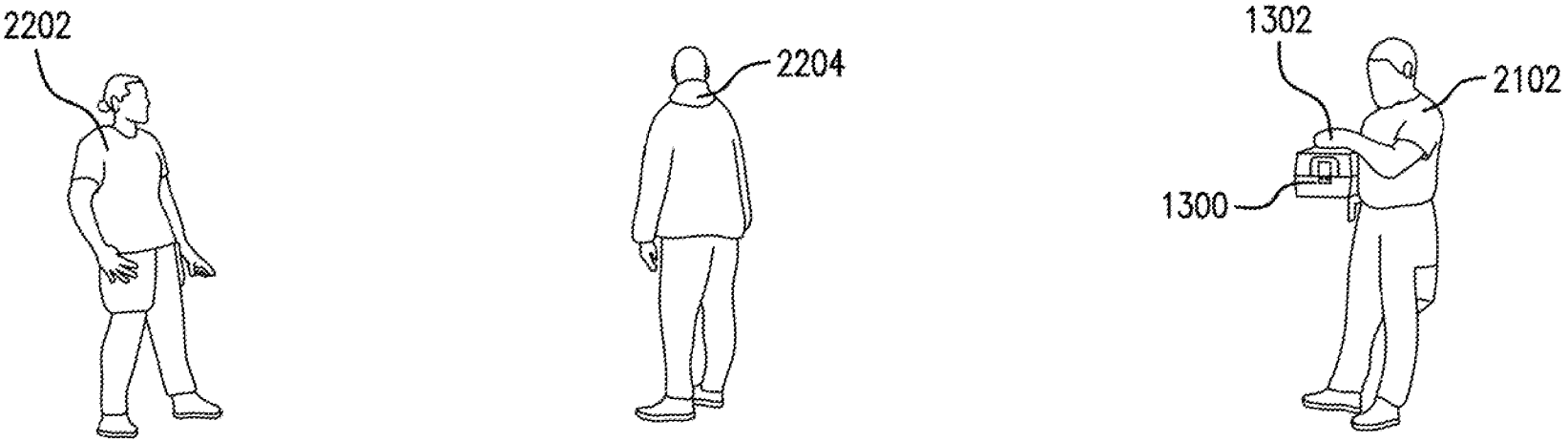
FIG. 22 illustrates an officer with the deployment system of FIG. 13, an assisting officer and a fugitive at a time $t_1$.

FIG. 22 illustrates officer 2102 with deployment system 1300, an assisting officer 2202 and a fugitive 2204 at a time $t_1$.

The process of restraining and securing fugitive 2204 starts with assisting officer 2202 distracting fugitive 2204, while officer 2102 carries deployment system 1300 into position behind fugitive 2204. Officer 2102 actuates targeting system 1302 towards fugitive 2204.

Figure 23:
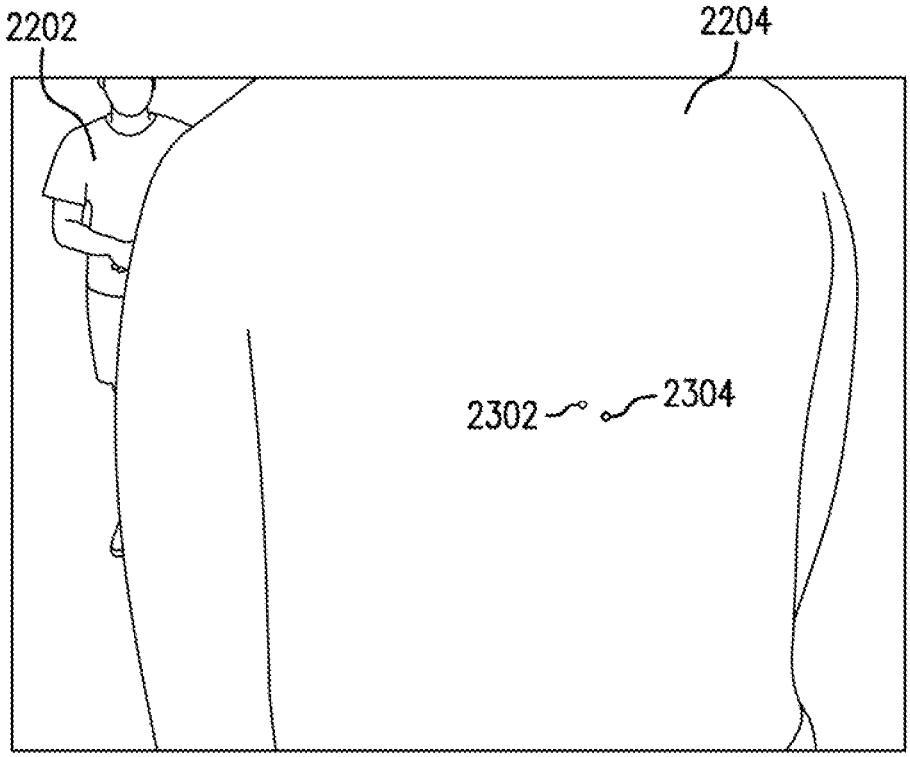
FIG. 23 illustrates the operation of the targeting system of FIG. 13 at a time $t_2$.

FIG. 23 illustrates the operation of targeting system 1302 at a time $t_2$. As shown in the figure, two laser beam dots 2302 and 2304 are displayed on the back of fugitive 2204.

Laser 1348 and laser 1350 are mounted on an angle to each other such that the laser beams converge at a set distance from fugitive 2204. The convergence point can be set by officer 2102 by adjusting the laser mounting angle. The mounting angle is set to match the adjustment made to cord extension 204. Officer 2102 moves toward or away from fugitive 2204 until the laser beams converge. That indicates that officer 2102 is at the proper distance to deploy containment system 100.

In an example embodiment, by releasing a trigger attached to grip 1312, officer 2102 releases a lock spring that keeps left shell 1308 and right shell 1310 of deployment system 1300 in a "ready to throw" configuration.

FIG. 24 illustrates launching of containment system 100 from deployment system 1300 at a time $t_3$.

As shown in the figure, with the container lock spring released, containment system 100 can be launched from deployment system 1300 with a forward and upward motion. The arms of officer 2102 must also separate from each other to provide a sideward thrust to lateral weights 406, 408, 410, 412, 414 and 416.

Figure 25:
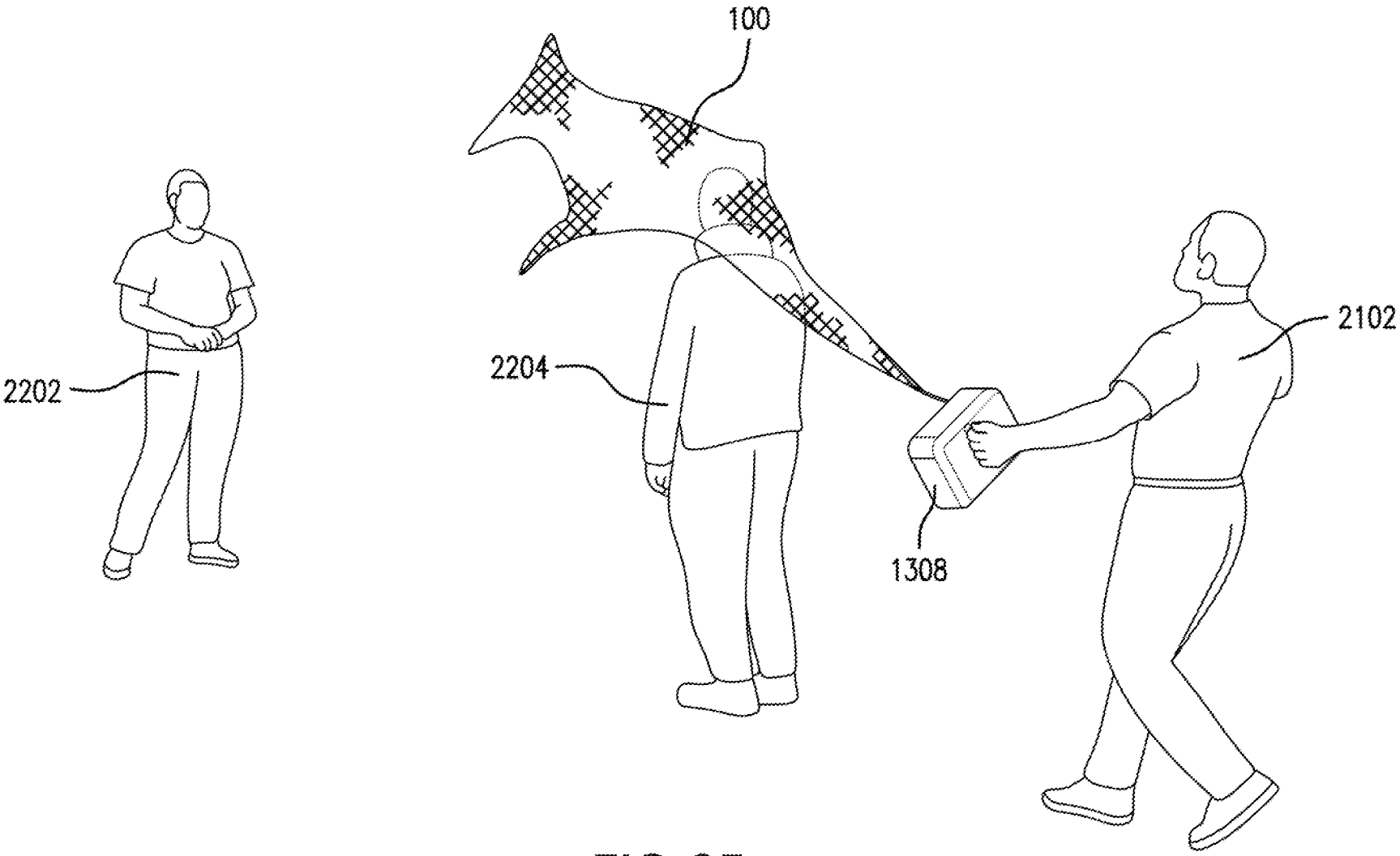
FIG. 25 illustrates the containment system of FIG. 1 starting to surround the fugitive at a time $t_4$.

FIG. 25 illustrates containment system 100 starting to surround fugitive 2204 at a time $t_4$.

As shown in the figure, as conical net 402 moves forward, lateral weights 406, 408, 410, 412, 414 and 416 provide the momentum to bring conical net 402 to its full diameter. User cord extension 204 and breakaway shoulder strap 202 limit the forward movement of conical net 402.

Figure 26:
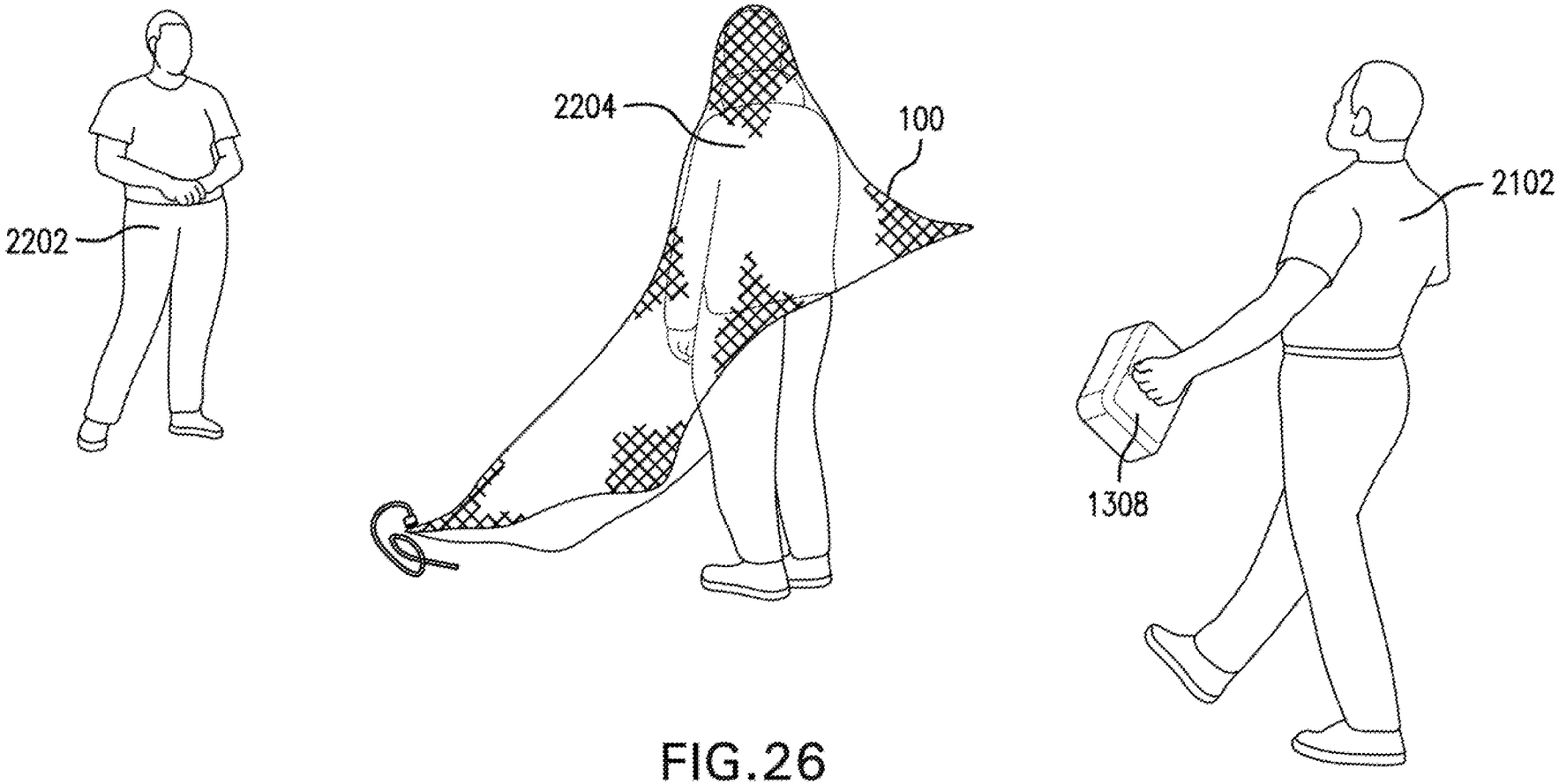
FIG. 26 illustrates the containment system of FIG. 1 continuing to surrounding the fugitive at a time $t_5$.

FIG. 26 illustrates containment system 100 continuing to surrounding fugitive 2204 at a time $t_5$.

As shown in the figure, primary weight 404 is disposed at or near circumference 407 of assistant end 106. In this manner, primary weight 404, which is the heaviest weight, carries conical net 100 beyond fugitive 2204 and onto the ground. In an example embodiment, primary weight 404 is displaced a distance away from circumference 470. The length of user cord extension 204 determines the distance that user handle 208 lands from officer 2102. The distance ranges from four to eight feet depending on the length of user cord extension 204.

Figure 27:
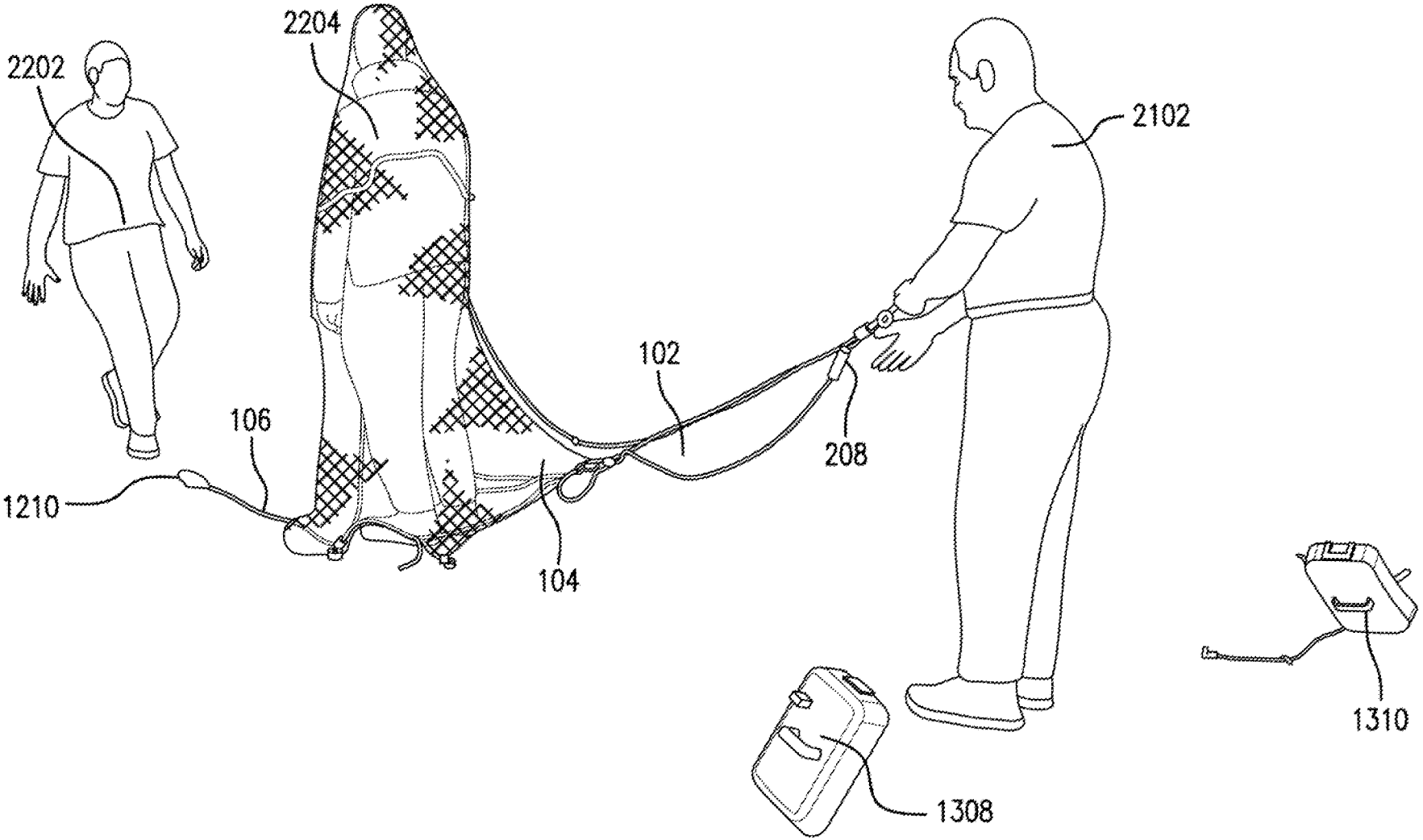
FIG. 27 illustrates the containment system of FIG. 1 surrounding the fugitive at a time $t_6$.

FIG. 27 illustrates containment system 100 surrounding fugitive 2204 at a time $t_6$.

As shown in the figure, officer 2102 drops deployment system 1300 and prepared to grab user handle 208. Assisting officer 2202 prepares to grab assistant handle extension 1208 and pulls it until assisting officer 2202 can reach assistant handle 1206. This whole sequence takes only a few seconds.

Figure 28:
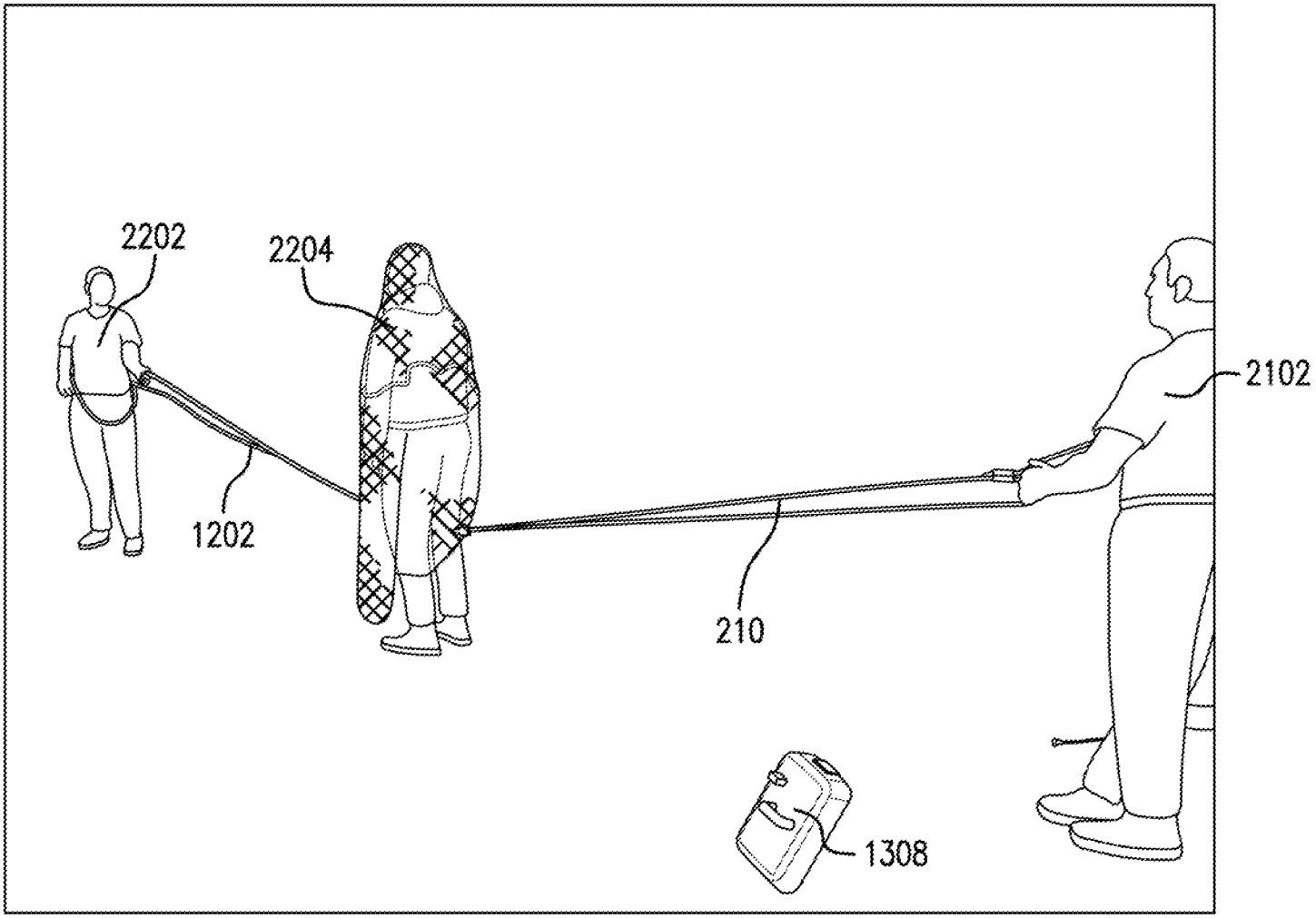
FIG. 28 illustrates containment system of FIG. 1 being constricted around the fugitive at a time $t_7$.

FIG. 28 illustrates containment system 100 being constricted around fugitive 2204 at a time $t_7$.

As shown in the figure, as assisting officer 2202 moves away from fugitive 2204 with assistant handle 1206, assistant cord 1202 pulls user one-way cord lock 212 towards fugitive 2204. Similarly, as officer 2102 moves away from fugitive 2204 with user handle 208, user cord 210 pulls assistant one-way cord lock 1204 towards fugitive 2204. User one-way cord lock 212 enables one-way movement of user cord 210 therethrough when pulled upon by officer 2102 by way of user handle 208 so as to constrict conical net 402 at circumference 470. Similarly, assistant one-way cord lock 1204 enables one-way movement of assistant cord 1202 therethrough when pulled upon by assisting officer 2202 by way of assistant handle 1206 so as to constrict conical net 402 at circumference 470.

The constriction of circumference 470 captures fugitive 2204. The capture is best performed if officer 2102 and assisting officer 2202 keep user handle 208 and assistant handle 1206 low to the ground in order to have conical net 100 gather as low as possible on fugitive 2204.

Fugitive 2204 is secured when officer 2102 and assisting officer 2202 have moved as far as possible away from fugitive 2204. User cord 210 and assistant cord 1202 are tight around fugitive 2204 and user one-way cord lock 212 and assistant one-way cord lock 1204 prevent conical net 100 from loosening. Because user cord 210 and assistant cord 1202 have tightened and locked around fugitive 2204, officer 2102 and assisting officer 2202 can hold user handle 208 and assistant handle 1206 to maintain a maximum distance to keep fugitive 2204 from attacking them or escaping.

Figure 29:
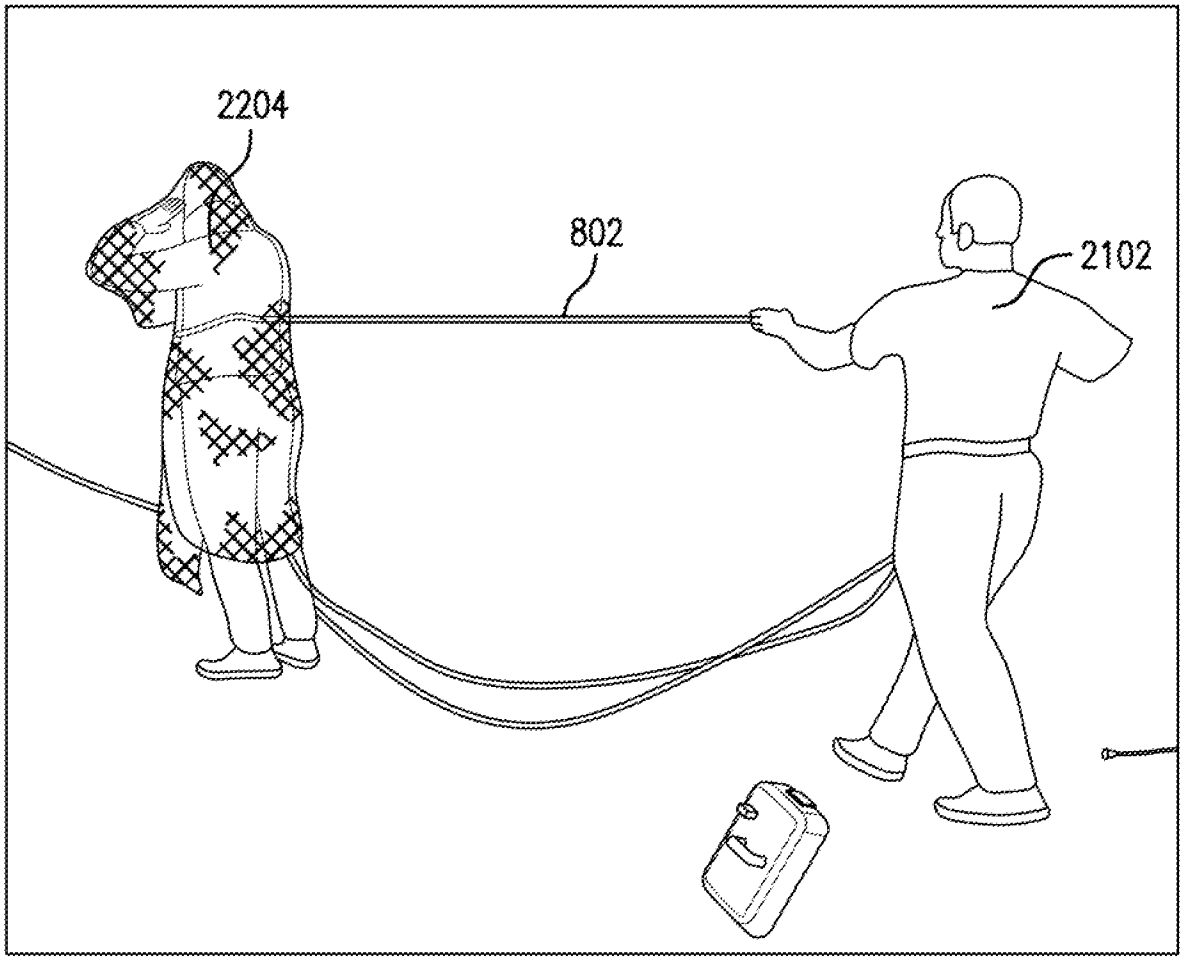
FIG. 29 illustrates a mid-level hobble of containment system of FIG. 1 being employed against the fugitive at a time $t_8$.

FIG. 29 illustrates mid-level hobble 462 of containment system 100 being employed against fugitive 2204 at a time $t_8$.

As shown in the figure, after user handle 208 and assistant handle 1206 are pulled to the full extent away from fugitive 2204, officer 2102 (or another officer that is available) grabs and pulls mid-level hobble cord 802 so that it tightens around the waist of fugitive 2204. The hands of fugitive 2204 should be above mid-level hobble 462 before mid-level hobble cord 802 is tightened.

Figure 30:
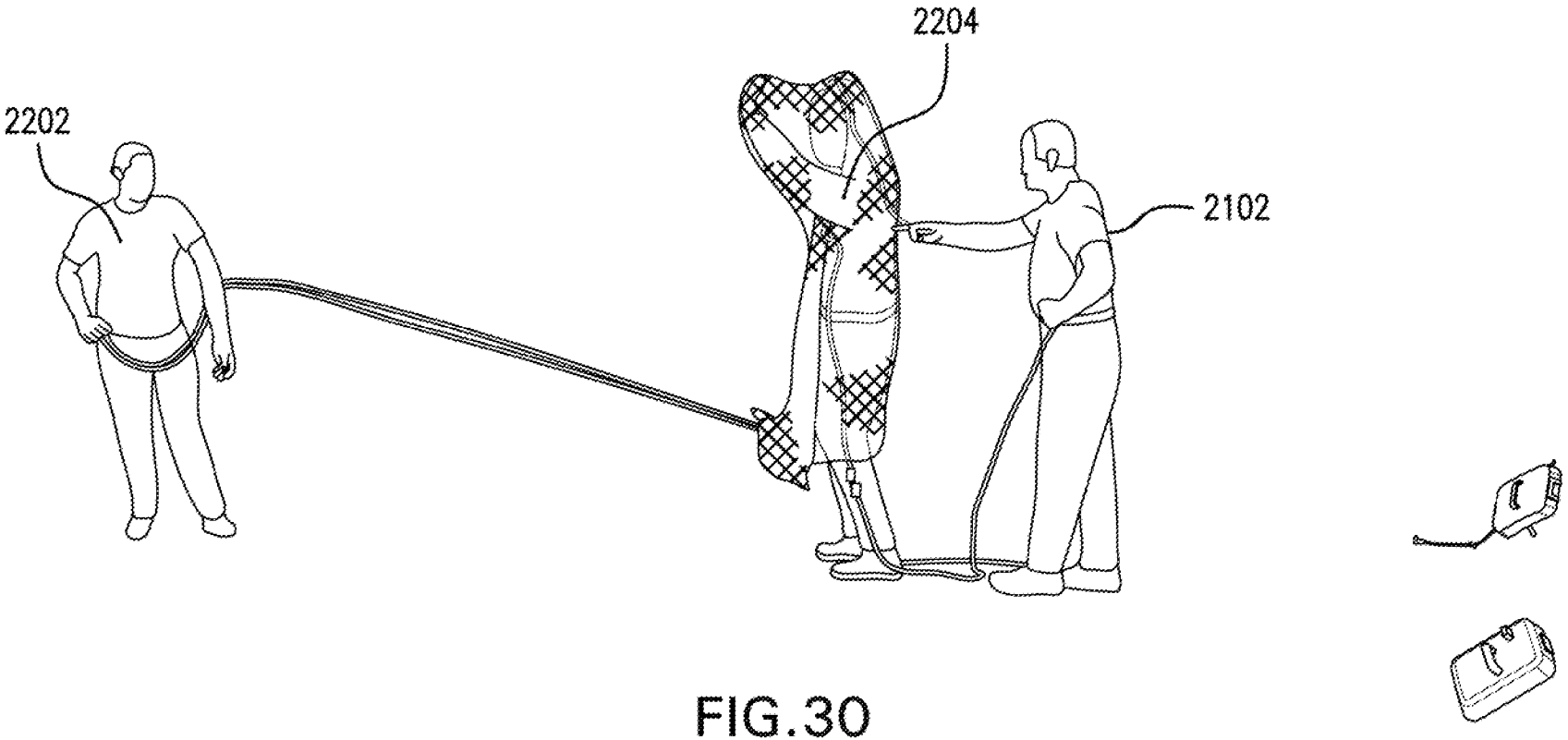
FIG. 30 illustrates the mid-level hobble being fully tightened around the fugitive at a time $t_9$.

FIG. 30 illustrates mid-level hobble 462 being fully tightened around fugitive 2204 at a time $t_9$.

As shown in the figure, mid-level hobble cord 802 is fully tightened around the waist of fugitive 2204 waist by pulling mid-level hobble cord 802 through mid-level hobble lock 804 until mid-level hobble lock 804 is against the waist of fugitive 2204. Note that assisting officer 2202 still has control of assistant handle 1206, which keeps assistant cord 1202 tight around the legs of fugitive 2204.

Figure 31:
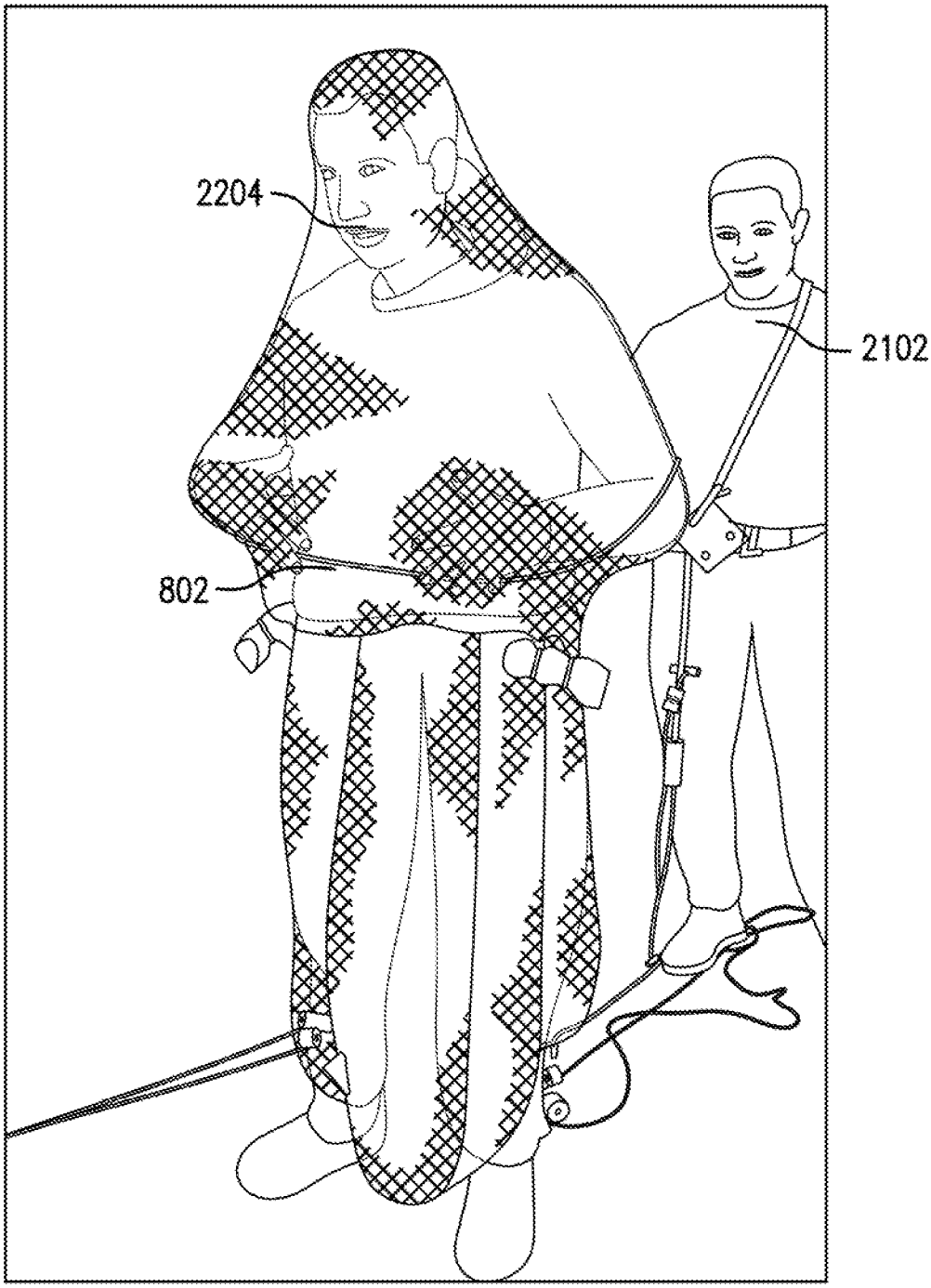
FIG. 31 illustrates another view of the mid-level hobble cord around the fugitive at time $t_9$.

FIG. 31 illustrates another view of mid-level hobble cord 802 around fugitive 2204 at time $t_9$.

Figure 32:
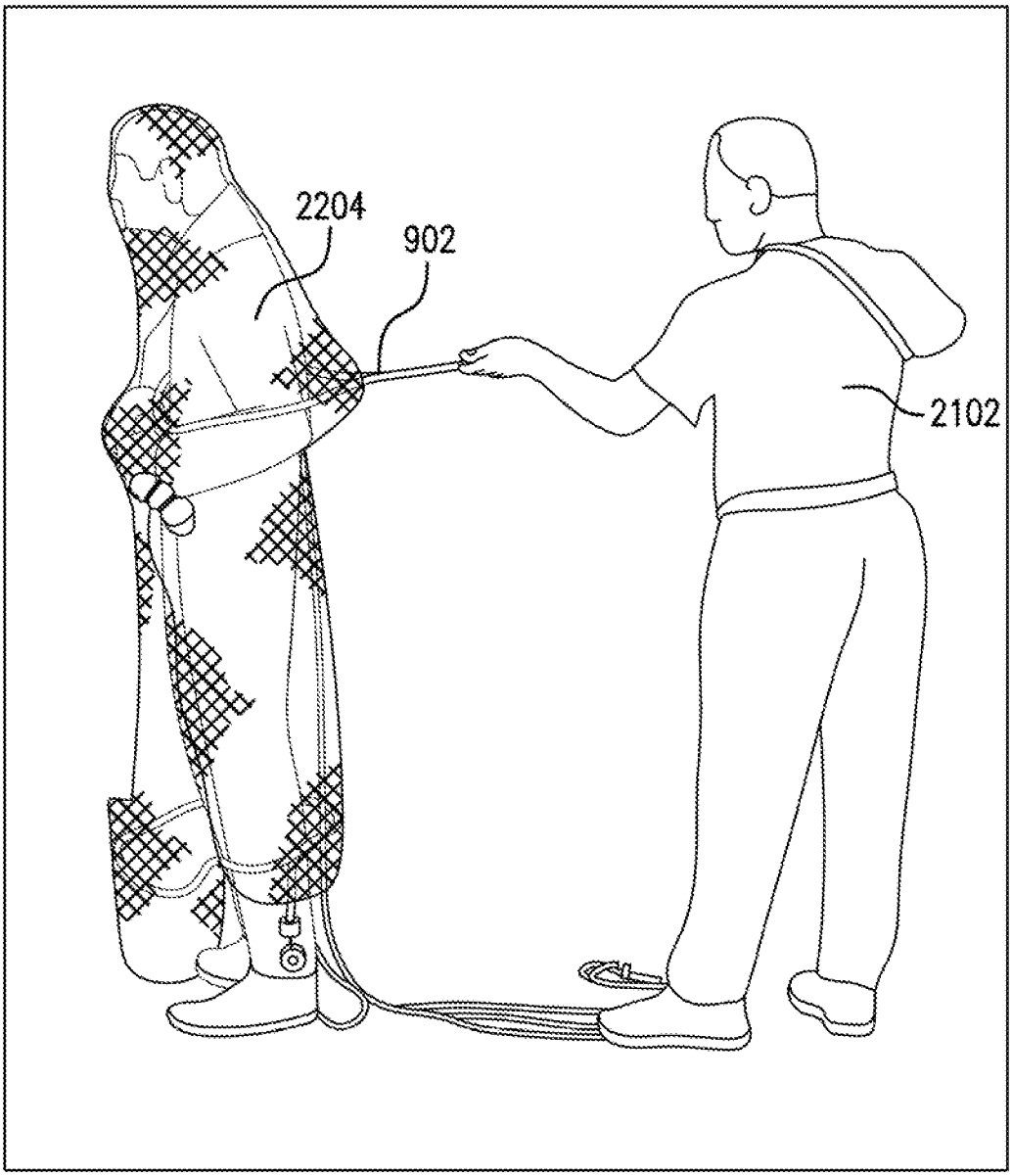
FIG. 32 illustrates the upper-level hobble of containment system of FIG. 1 being employed against the fugitive at a time $t_{10}$.

As shown in the figure, in this position, fugitive 2204 is unable to reach their hands into their pants pockets where a weapon could be hidden FIG. 32 illustrates upper-level hobble 464 of containment system 100 being employed against fugitive 2204 at a time $t_{10}$.

As shown in the figure, if fugitive 2204 continues to thrash their arms around, upper-level hobble cord 902 can be pulled in tight around the arms of fugitive 2204. Upper-level hobble 464 is locked in place by upper-level hobble lock 904.

Figure 33:
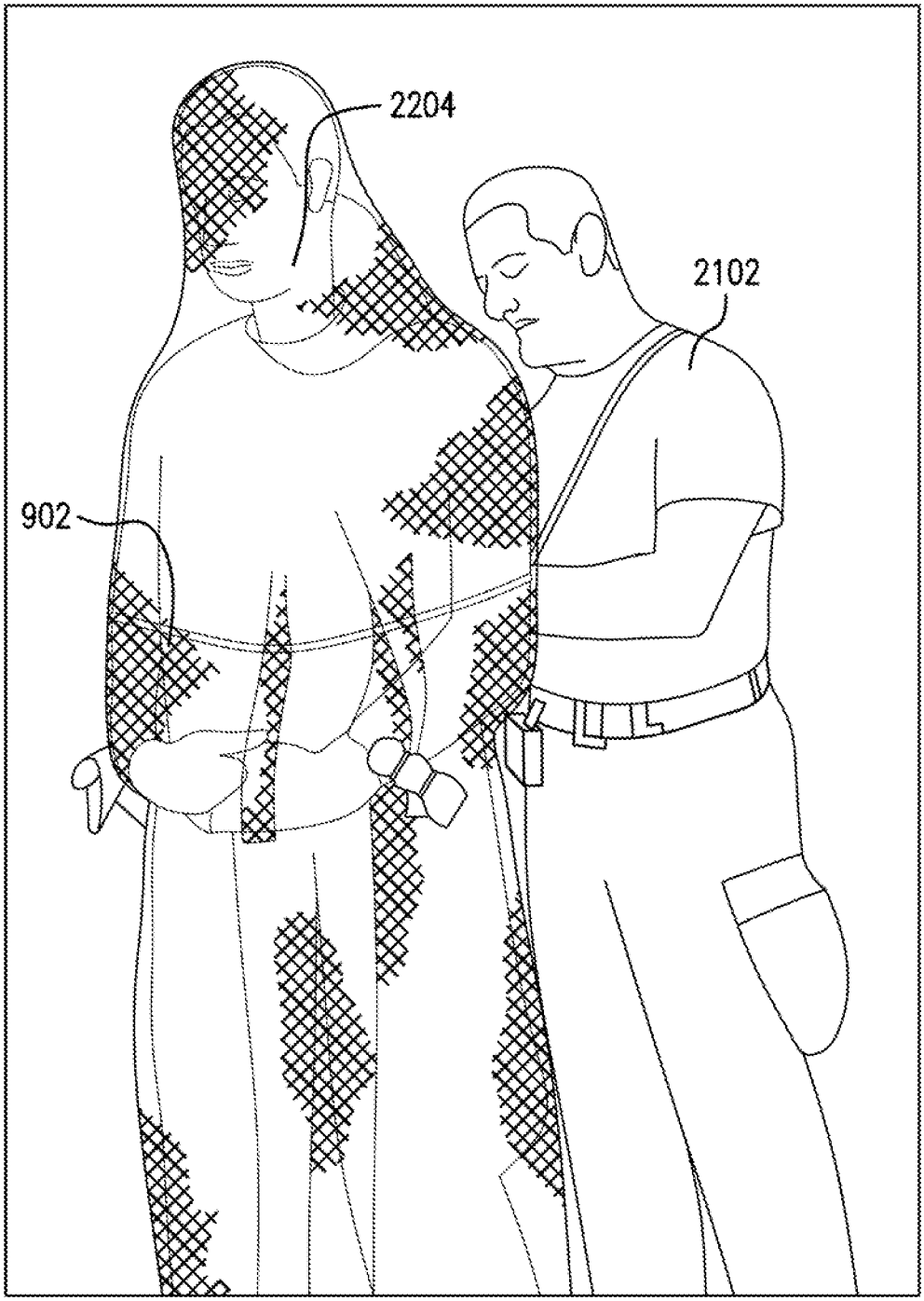
FIG. 33 illustrates another view of the upper-level hobble cord around the fugitive at time $t_{10}$.

FIG. 33 illustrates another view of upper-level hobble cord 902 around fugitive 2204 at time $t_{10}$.

As shown in the figure, in this position, fugitive 2204 has their arms constricted and the hands cannot reach into their pants pockets. If fugitive 2204 still does not calm down, any officer can grab conical net 100 and pull fugitive 2204 to the ground (not shown). Breakaway shoulder strap 202 can be used as an additional hobble around the feet of fugitive 2204 if they continue to kick (not shown).

Figure 34:
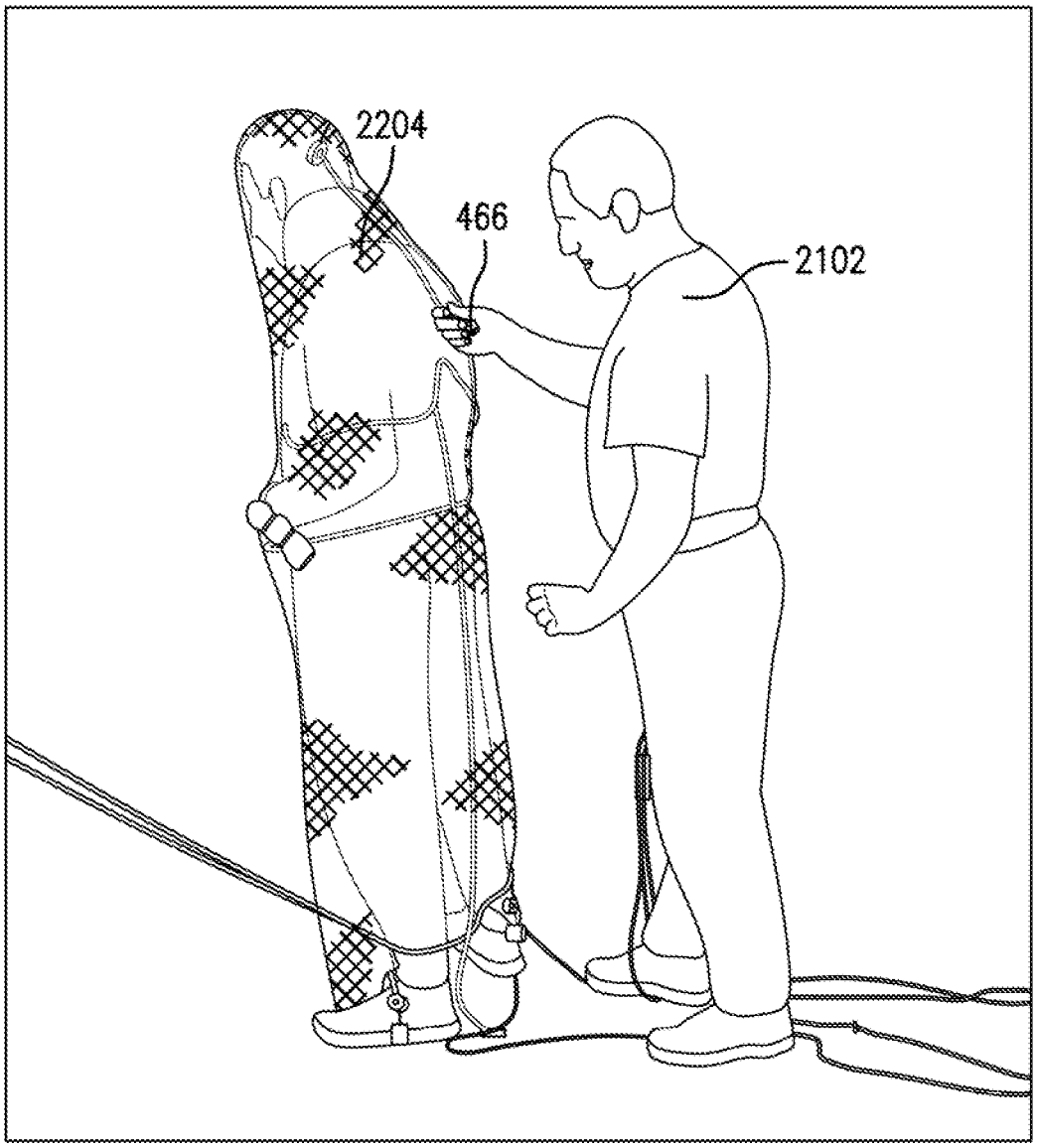
FIG. 34 illustrates the use of a mid-level net release of FIG. 1 at a time $t_{11}$.

FIG. 34 illustrates the use of mid-level net release 466 at a time $t_{11}$.

As shown in the figure, the next step is to handcuff fugitive 2204. This is done by opening mid-level slit 1002 of mid-level net release 466 in conical net 402. Officer 2102 (or another officer) releases mid-level release thread 1004 from mid-level release thread clip 1006 and the pulls on mid-level release thread grip 1008. Mid-level release thread grip 1008 may be any device that enables a user to find and hold mid-level release thread 1004, but is of a sufficient size and shape so as to prevent the end of mid-level release thread 1004 from unweaving through net 402. In an example embodiment, mid-level release thread grip 1008 is a ring having a circumference that is larger than an opening in conical net 402.

When mid-level release thread 1004 is fully removed from conical net 402, mid-level slit 1002 in the middle of the back will open.

Figure 35:
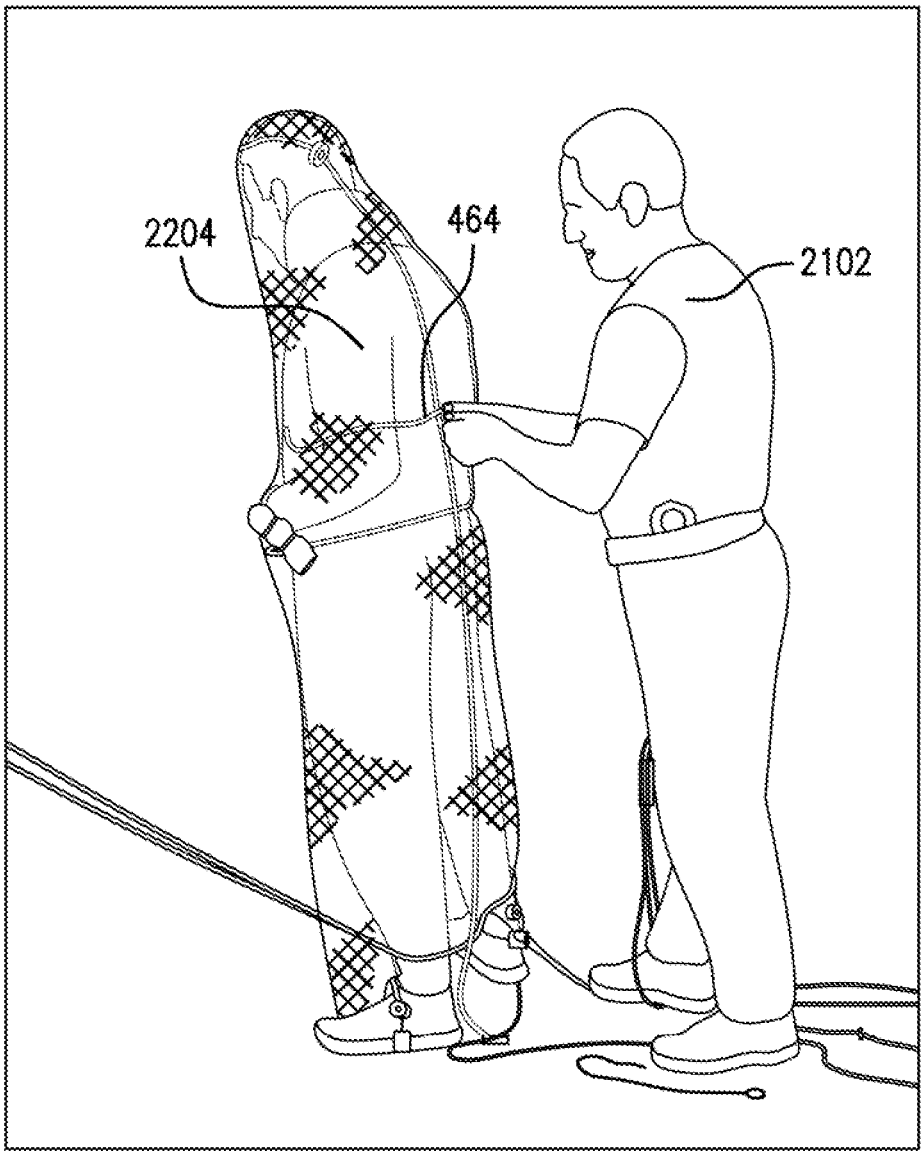
FIG. 35 illustrates releasing of the upper-level hobble at a time $t_{12}$.

FIG. 35 illustrates releasing of upper-level hobble 464 at a time $t_{12}$.

As shown in the figure, if upper-level hobble 464 has been secured, upper-level hobble lock 904 will need to be released so that upper-level hobble cord 902 can be loosened.

Figure 36:
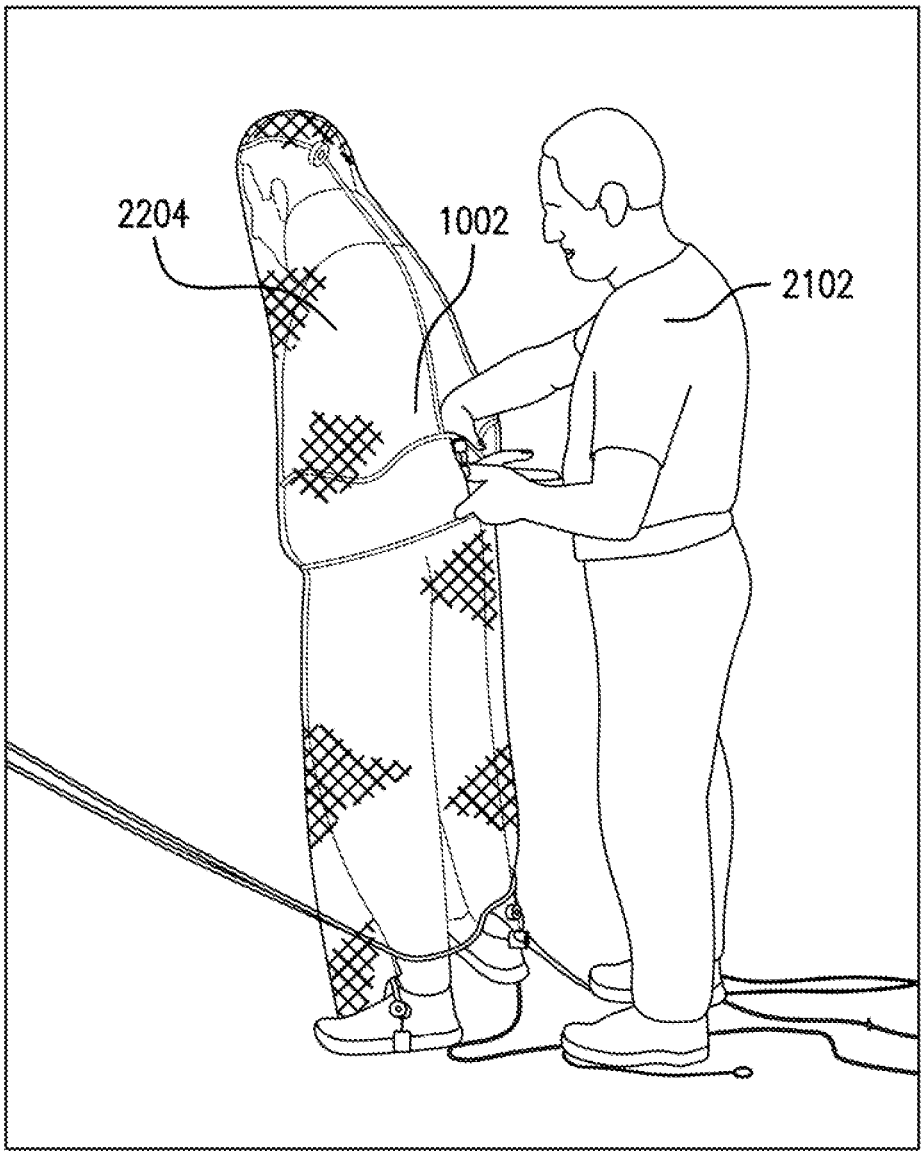
FIG. 36 illustrates accessing the hands of the fugitive through the mid-level slit at a time $t_{13}$.

FIG. 36 illustrates accessing the hands of fugitive 2204 through mid-level slit 1002 at a time $t_{13}$.

As shown in the figure, the officer that has opened mid-level net release 466 now has access to the wrists of fugitive 2204 to apply handcuffs.

Figure 37:
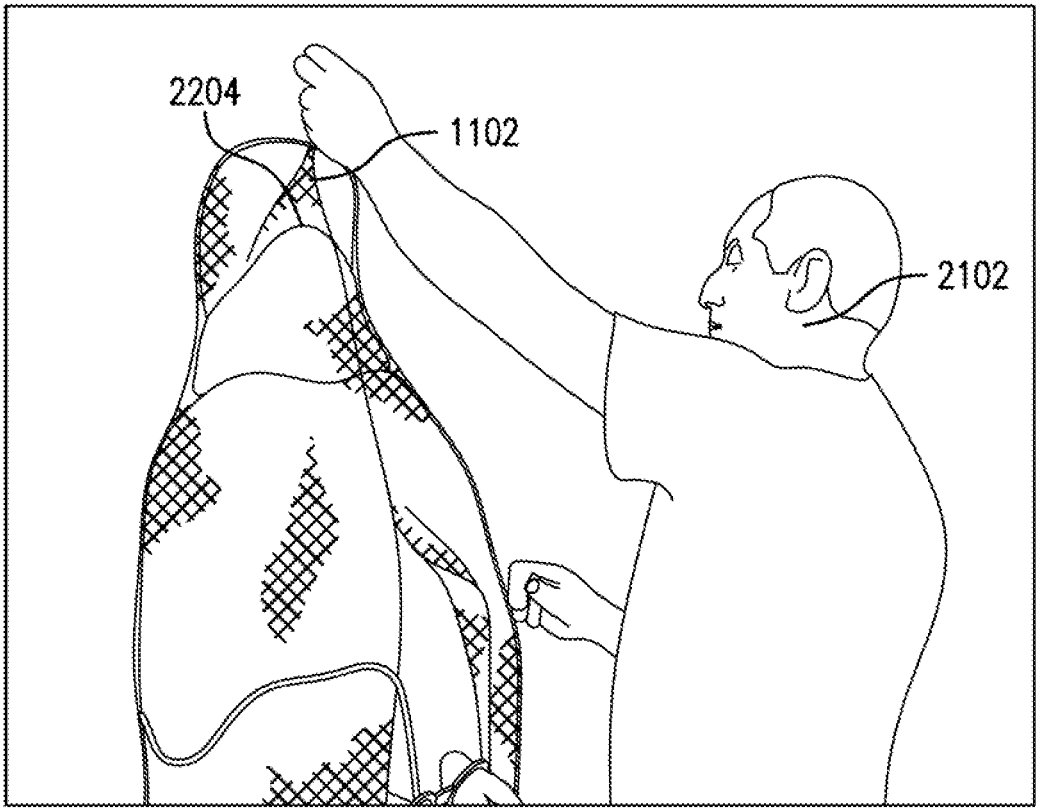
FIG. 37 illustrates releasing the fugitive via the upper-level slit at a time $t_{14}$.

FIG. 37 illustrates releasing fugitive 2204 via upper-level slit 1102 at a time $t_{14}$.

As shown in the figure, the final step is to release fugitive 2204 from containment system 100. Normally this is done after fugitive 2204 is handcuffed, but in some cases, fugitive 2204 may need to be released because of a medical or other emergency. Both cases are handled the same way. It is not necessary to open mid-level slit 1002 in order to release fugitive 2204 from containment system 100. Upper-level hobble cord 902 should be released so that conical net 402 will drop to the ground, once upper-level slit 1102 in conical net 402 is opened. Officer 2102 (or another officer) may release upper-level release thread 1104 from upper-level release thread clip 1106 and then pull on upper-level release thread grip 1108. Upper-level release thread grip 1108 may be any device that enables a user to find and hold upper-level release thread 1104, but is of a sufficient size and shape so as to prevent the end of upper-level release thread 1104 from unweaving through net 402. In an example embodiment, upper-level release thread grip 1108 is a ring having a circumference that is larger than an opening in conical net 402.

When upper-level release thread 1104 is fully removed from containment system 100, upper-level slit 1102 in the top of conical net 402 will open.

Figure 38:
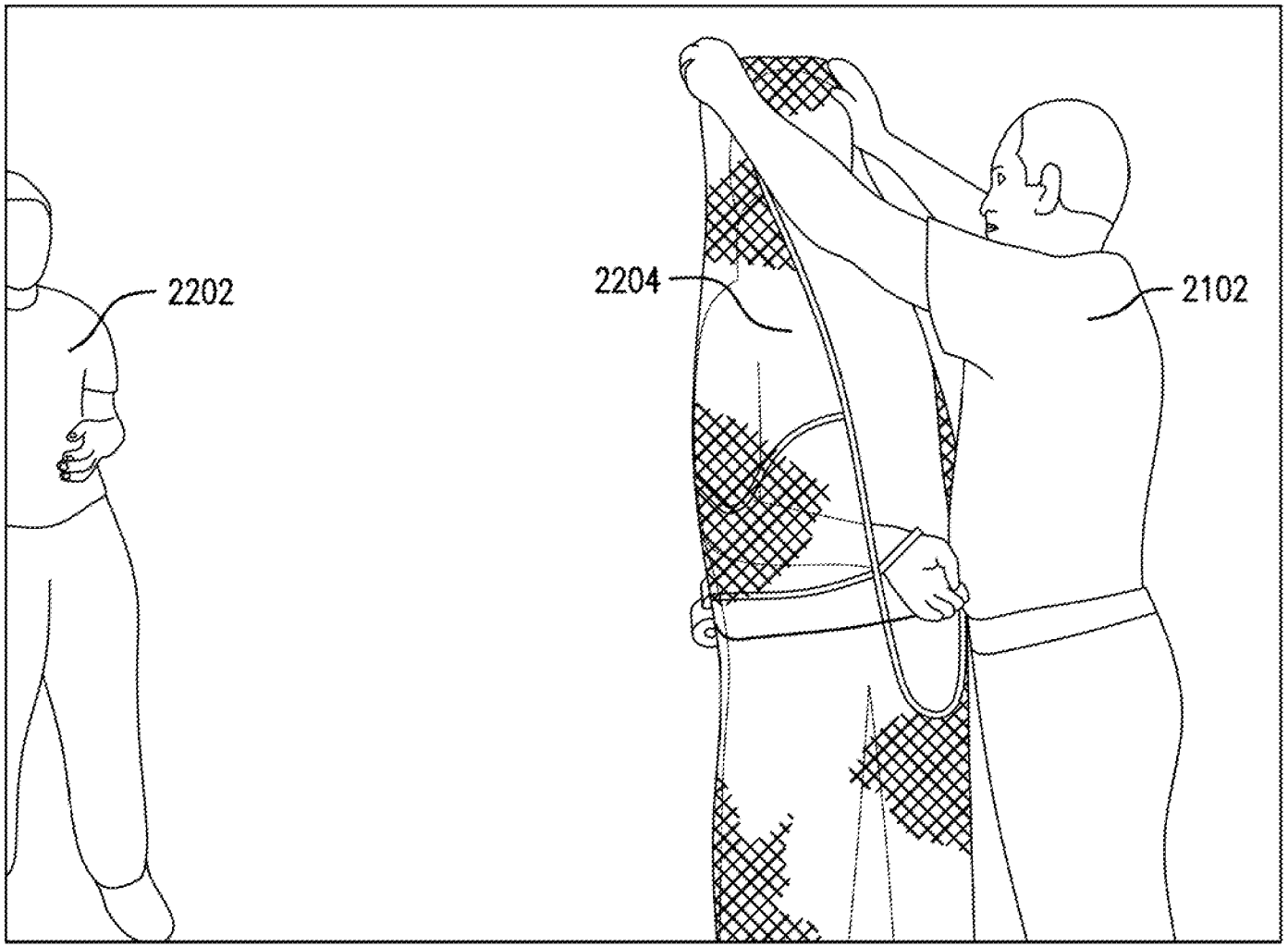
FIG. 38 illustrates removing the conical net from the fugitive at a time $t_{15}$.

FIG. 38 illustrates removing conical net 402 from fugitive 2204 at a time $t_{15}$.

As shown in the figure, conical net 402 may then be pulled over the head of fugitive 2204.

Figure 39:
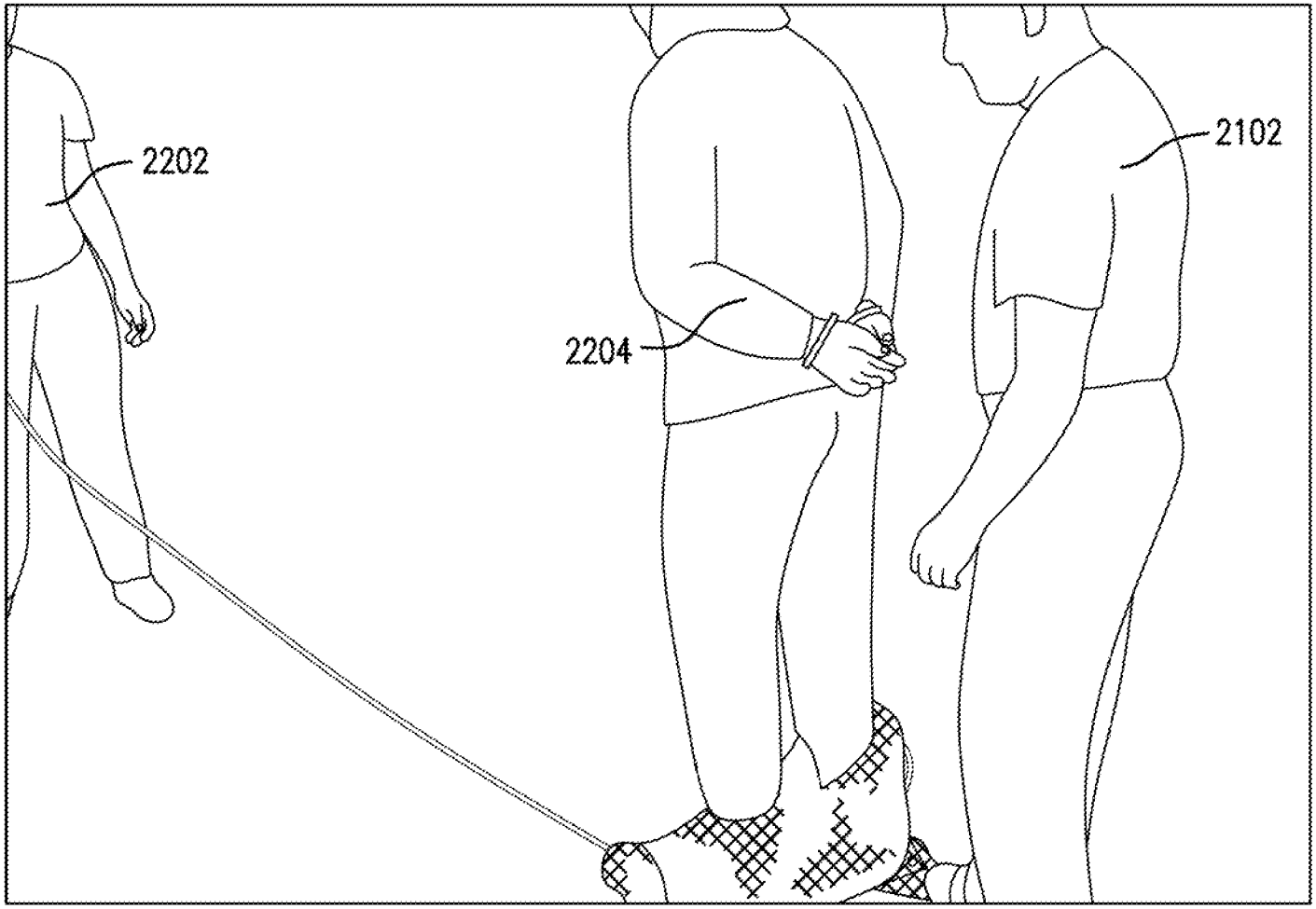
FIG. 39 illustrates fully removing the conical net from the fugitive at a time $t_{16}$.

FIG. 39 illustrates fully removing conical net 402 from fugitive 4 at a time $t_{16}$.

As shown in the figure, conical net 402 can be pulled to the ground so that fugitive 2204 can be step out of it. After deployment, all of the components should be cleaned and inspected before repacking containment system 100 for future deployment.

The above-discussed non-limiting example embodiments are used to restrain a fugitive. It should be noted that in a broader sense, aspects of the present invention may be used to deploy a containment system on any target.

The foregoing description of various preferred embodiments have been presented for purposes of illustration and description. It is not intended to be exhaustive or to limit the invention to the precise forms disclosed, and obviously many modifications and variations are possible in light of the above teaching. The example embodiments, as described above, were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed as new and desired to be protected by Letters Patent of the United States is:

1. A containment system comprising:

a net having a perimeter and a center;

a first weight disposed at said perimeter;

a second weight disposed at said perimeter;

a primary weight connected to said net;

a user cord;

a user one-way cord lock;

an assistant one-way cord lock; and an assistant cord disposed through said assistant one-way cord lock and associated with said perimeter, wherein said user cord is disposed through said user one-way cord lock and is associated with said perimeter;

wherein said user one-way cord lock enables one-way movement of said user cord therethrough when said user cord is pulled so as to constrict said net at said perimeter and to prevent said net from expanding at said perimeter; and wherein said assistant one-way cord lock enables one-way movement of said assistant cord therethrough when pulled upon so as to constrict said net at said perimeter.

2. The containment system of claim 1, wherein said user one-way cord lock is disposed substantially on an axis including the center and the assistant one-way cord lock, and wherein the center is disposed between said user on-way cord lock and said assistant one-way cord lock.

3. The containment system of claim 1, wherein said user one-way cord lock includes a first user cord entrance, a first user cord lock/release mechanism, a first user cord exit, a second user cord entrance, a second user cord lock/release mechanism and a second user cord exit, wherein said assistant one-way cord lock includes a first assistant cord entrance, a first assistant cord lock/release mechanism, a first assistant cord exit, a second assistant cord entrance, a second assistant cord lock/release mechanism and a second assistant cord exit, wherein said user cord is disposed through said first user cord entrance, through said first user cord lock/release mechanism, through said first user cord exit, associated with said perimeter, through said second user cord entrance, through said second user cord lock/release mechanism, and through said second user cord exit, and wherein said assistant cord is disposed through said first assistant cord entrance, through said first assistant cord lock/release mechanism, through said first assistant cord exit, associated with said perimeter, through said second assistant cord entrance, through said second assistant cord lock release mechanism and through said second assistant cord exit.

4. The containment system of claim 3, further comprising:

wherein said user one-way cord lock further includes a user non-locking opening, wherein said assistant one-way cord lock further includes an assistant non-locking opening, wherein said user cord is further disposed through said assistant non-locking opening, and wherein said assistant cord is further disposed through said user non-locking opening.

5. The containment system of claim 1, further comprising:

a mid-level net release including a mid-level slit, a mid-level release thread, amid-level release thread clip and a mid-level release thread grip, wherein said mid-level slit is disposed between said center and said perimeter, wherein said mid-level release thread has a first end and a second end and is woven in said net between sides of said mid-level slit, wherein said mid-level release thread clip is connected to said first end of said mid-level release thread and operable to detachably fasten to said net, and wherein said mid-level thread grip is attached to said second end of said mid-level release thread.

6. The containment system of claim 1, further comprising:

an upper-level net release including an upper-level slit, an upper-level release thread, an, upper-level release thread clip and an upper-level release thread grip, wherein said upper-level slit is disposed from said center to a position between said center and said perimeter, wherein said upper-level release thread has a first end and a second end and is woven in said net between sides of said upper-level slit, wherein said upper-level release thread clip is connected to said first end of said upper-level release thread and operable to detachably fasten to said net, and wherein said upper-level thread grip is attached to said second end of said upper-level release thread.

* * * * *